US006780578B2

(12) United States Patent
Yoshioka et al.

(10) Patent No.: US 6,780,578 B2
(45) Date of Patent: Aug. 24, 2004

(54) THERMALLY DEVELOPABLE PHOTOSENSITIVE MATERIAL

(75) Inventors: Yasuhiro Yoshioka, Minami-Ashigara (JP); Keiichi Suzuki, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/395,381

(22) Filed: Mar. 25, 2003

(65) Prior Publication Data

US 2003/0190568 A1 Oct. 9, 2003

(30) Foreign Application Priority Data

Mar. 29, 2002 (JP) ..... 2002-097159

(51) Int. Cl.[7] ..... G03C 1/498; G03C 1/34

(52) U.S. Cl. ..... 430/600; 430/598; 430/607; 430/603; 430/610; 430/619; 430/620

(58) Field of Search ..... 430/619, 600, 430/603, 607, 613, 614, 620, 610, 599, 598

(56) References Cited

U.S. PATENT DOCUMENTS 3,667,959 A 6/1972 Bojara et al.
6,489,091 B2 * 12/2002 Takiguchi ..... 430/619

FOREIGN PATENT DOCUMENTS

JP 2001281793 * 10/2001

* cited by examiner

*Primary Examiner*—Thorl Chea
(74) *Attorney, Agent, or Firm*—Taiyo, Nakajima & Kato

(57) ABSTRACT

The thermally developable photosensitive material of the present invention has a support and including on at least one surface of the support a photosensitive silver halide, a non-photosensitive organic silver salt, a reducing agent for thermal development, a binder and a compound represented by the following general formula (1):

Formula (1)

wherein $R_1$ represents a hydrogen atom, an alkyl group, a cycloalkyl group, an aryl group or a heterocyclic group; X represents a chalcogen atom; and Y represents an amino group, an N-alkylamino group, an N,N-dialkylamino group, an anilino group, a hydroxyl group, an alkoxy group, an aryloxy group, an acylamino group or a sulfonamide group, and wherein when Y represents an alkoxy group, an alkylamino group, a dialkylamino group, an acylamino group or a sulfonamide group, Y and $R_1$ may be bonded to each other to form a 5- to 7-membered ring.

20 Claims, No Drawings

THERMALLY DEVELOPABLE PHOTOSENSITIVE MATERIAL

BACKGROUND OF THE INVENTION

1. Field of the Invention

The present invention relates to a thermally developable photosensitive material. More specifically, the invention relates to a thermally developable photosensitive material that has fewer fluctuations involving sensitivity, gradation and silver color tone due to variation of temperature or duration of thermal development.

2. Description of the Related Art

Recently in medical fields, it has been strongly desired, from the standpoints of environmental protection and space-saving, to reduce the volume of processing waste fluids. Thus, there is a need for technologies relating to thermally developable photosensitive materials (heat development-type photosensitive materials) which can be efficiently exposed by a laser image setter or a laser imager to form clear black images having high resolution and sharpness. These thermally developable photosensitive materials are advantageous in providing customers with a thermal processing system that does not need liquid-type processing solutions, and which is simple and not harmful to the environment.

There is also a need for the same technologies in the field of ordinary image forming materials. In particular, in the field of medical diagnosis, which requires detail depiction, high quality images excellent in sharpness and graininess are needed and blue black image tone is desired in view of diagnosing readiness. Currently, various types of hard copy systems using pigments and dyes, for example, ink jet printers and electrophotographic systems are widely used as the ordinary imaging system. However, satisfactory systems for outputting images for use in medical diagnosis have not been developed.

On the other hand, thermally developable image forming systems using organic silver salts are described, for example, in U.S. Pat. Nos. 3,152,904 and 3,457,075, and in "Thermally Processed Silver Systems (Imaging Processes and Materials)" written by B. Shely, Neblette, 8th Ed., edited by J. Sturge, V. Walworth & A. Shepp, Chap. 9, p. 279, 1989. In general, thermally developable photosensitive materials have a photosensitive layer (image-forming layer) produced by dispersing a catalytically active amount of a photocatalyst (e.g., silver halide), a reducing agent, a reducible silver salt (e.g., organic silver salt), and optionally a toning agent for adjusting silver color tone in a binder matrix. Thermally developable photosensitive materials of this type are, after having been imagewise exposed, heated to an elevated temperature (for example, at 80° C. or higher) to form black silver images through redox reaction between a reducible silver salt (acting as an oxidizing agent) and a reducing agent. The redox reaction is accelerated by catalytic action of latent images which have been formed on silver halides exposed. Therefore, the black silver images are formed in the exposed area. This technique is disclosed in many references, such as U.S. Pat. No. 2,910,377 and Japanese Patent Application Publication (JP-B) No.43-4924, and as a result, Fuji Medical Dry Imager FM-DP L that utilizes the thermally developable photosensitive material is commercially available as an image-forming system for use in the medical field.

In the thermally developable photosensitive system, images are formed by silver grains which are generated at the time of heating due to a physical phenomenon, and a size or a size distribution thereof momentarily changes depending on a developing temperature or a developing time duration. Therefore, this system has a drawback in that in compliance with a fluctuation of the developing temperature or developing time duration, the size or the size distribution varies and, accordingly, sensitivity or graduation is fluctuated. Further, a silver color tone also changes depending on the temperature or time duration. Such a fluctuation or change of finished materials leads to a problematic matter of a lowered diagnostic ability at the time of diagnosis, and hence, an improvement is desired.

Various attempts have been made to reduce liability of the thermally developable photosensitive material to be influenced by developing conditions. Japanese patent Application Laid-Open (JP-A) No. 10-104780 describes that temperature dependency is improved when a mixture of two or more kinds of organic acid silvers is used. However, this method has a problem of deteriorated image storability. JP-A Nos. 2000-267222, 2001-92075 and 2001-264925 disclose use of a developing accelerator. However, a problem arises in this case that the image storability or the image color tone is impaired. JP-A No. 2000-321712 discloses a method to use a precursor that releases a developing inhibitor. However, this method involves problems of an unfavorable decrease in sensitivity and a reduced image density, and hence, this method has not been actually used. JP-A Nos. 10-62899, 10-186572 and EP-A No. 0,803,764 disclose that addition of a heterocyclic thione compound or a heterocyclic mercapto compound to an image-forming layer of the thermally developable photosensitive material serves to suppress development, augment spectrally sensitizing efficiency or improve storability before and after the thermally developable photosensitive material is developed. However, there has not yet been known any compound which can reduce liability of the thermally developable photosensitive material to be influenced by developing conditions, and the heterocyclic thione compound or the heterocyclic mercapto compound does not have such an effect.

In light of the above, there is a need for an improved thermally developable photosensitive material.

SUMMARY OF THE INVENTION

An object of the present invention is to provide a thermally developable photosensitive material that reduces fluctuations of photographic performances such as sensitivity, gradation and silver color tone due to a variation of processing conditions such as a temperature or a time duration performing thermal development, and achieves a consistent finished quality even when a change in installing circumstances of a thermal developing apparatus and a change thereof with time arises.

The aforementioned object of the invention has been achieved using a thermally developable photosensitive material described below.

The present invention provides a thermally developable photosensitive material having a support, and comprising on at least one surface of the support a photosensitive silver halide, a non-photosensitive organic silver salt, a reducing agent for thermal development, a binder, and a compound represented by the following general formula (1):

Formula (1)

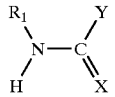

wherein $R_1$ represents a hydrogen atom, an alkyl group, a cycloalkyl group, an aryl group or a heterocyclic group; X represents a chalcogen atom; and Y represents an amino group, an N-alkylamino group, an N,N-dialkylamino group, an anilino group, a hydroxyl group, an alkoxy group, an aryloxy group, an acylamino group or a sulfonamide group, and wherein when Y represents an alkoxy group, an alkylamino group, a dialkylamino group, an acylamino group or a sulfonamide group, Y and $R_1$ may be bonded to each other to form a 5- to 7-membered ring.

It is preferable that, in the general formula (1), X represents an oxygen atom or a sulfur atom; and Y represents a substituted or unsubstituted amino group, anilino group or acylamino group.

The compound represented by the general formula (1) is preferably an urea or a thiourea.

DESCRIPTION OF THE PREFERRED EMBODIMENT

The present invention will be described in detail hereinafter.

1. Thermally Developable Photosensitive Material

A thermally developable photosensitive material according to the invention includes a support, and having disposed on at least one surface of the support, an image-forming layer comprising a photosensitive silver halide, a non-photosensitive organic silver salt, a reducing agent, a compound represented by a general formula (1) and a binder. Preferably, the thermally developable photosensitive material may include a surface protective layer on the image-forming layer, or may include a back layer, a back protective layer or the like on an opposite surface.

A construction and preferable components of respective layers are described in detail below.

2-1. Image-Forming Layer 2-1-1. Compound of General Formula (1)

First, a compound represented by the following general formula (1) according to the inventions is described in detail.

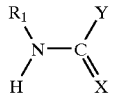

In the formula (1), $R_1$ preferably represents a hydrogen atom, an alkyl group having from 1 to 30 carbon atoms, a cycloalkyl group having from 5 to 30 carbon atoms, an aryl group having from 6 to 30 carbon atoms or a heterocyclic group having from 1 to 30 carbon atoms. When $R_1$ is an alkyl group, specific examples of such alkyl groups include a methyl group, an ethyl group, a propyl group, an isopropyl group, an n-butyl group, a tert-butyl group, a tert-amyl group, an n-hexyl group, an n-octyl group, a dodecyl group, an octadecyl group, a 2-ethylhexyl group, a benzyl group, a phenoxyethyl group, a dodecylthioethyl group and a methoxyethoxyethyl group.

When $R_1$ is an aryl group, specific examples of such aryl groups include a phenyl group, a naphthyl group, a cresyl group, a xylyl group, a mesityl group, a 4-methoxyphenyl group, a 3-chlorophenyl group, a 2,4-dichlorophenyl group, a 4-cyanophenyl group, a 3-methane sulfonamide phenyl group, a 4-methylsulfonylphenyl group and the like. When $R_1$ is a cycloalkyl group, specific examples of such cycloalkyl groups include a cyclopropyl group, a cyclobutyl group, a cyclopentyl group and a cyclohexyl group, and these groups may further have a substituent. When $R_1$ is a heterocyclic group, the heterocyclic group is preferably a saturated or unsaturated 5- to 7-membered heterocyclic group. Examples of such heterocyclic groups include pyrrolidine, pyrazine, piperazine, piperidine, morpholine, oxazine, oxazolidine, hydantoin, pyridine, pyrimidine and pyridazine, among these heterocyclic groups, morpholine, oxazolidine and hydantoin are more preferable.

In the formula (1), X represents a chalcogen atom, preferably an oxygen atom or a sulfur atom, and more preferably an oxygen atom.

When X is a sulfur atom, $R_1$ is preferably a hydrogen atom.

In the formula (1), Y preferably represents an amino group, an N-alkylamino group having from 1 to 30 carbon atoms, an N,N-dialkylamino group having a total of 2 to 40 carbon atoms, an anilino group having from 6 to 30 carbon atoms, a hydroxyl group, an alkoxy group having from 1 to 30 carbon atoms, an aryloxy group having from 6 to 30 carbon atoms, an acylamino group having from 1 to 30 carbon atoms and a sulfonamide group having from 1 to 30 carbon atoms.

When Y represents an amino group, it may be substituted by an alkyl group or an aryl group.

Y may be substituted by a halogen atom, an alkyl group, an aryl group, a hydroxyl group, an alkoxy group, an aryloxy group, an alkylthio group, an arylthio group, an acyl group, an alkoxycarbonyl group, a sulfonamide group, a sulfamoyl group, a carbamoyl group, an acyloxy group, a cyano group, a ureido group, a urethane group, a heterocyclic group or the like. When a substituent for Y is a group having an alkyl group, specific examples of such alkyl groups include a methyl group, an ethyl group, a propyl group, an isopropyl group, an n-butyl group, a tert-butyl group, a tert-amyl group, an n-hexyl group, an n-octyl group, a dodecyl group, an octadecyl group, a 2-ethylhexyl group, a benzyl group, a phenoxyethyl group, a dodecylthioethyl group and a methoxyethoxyethyl group. When a substituent for Y is a group having an aryl group, specific examples of such aryl groups include a phenyl group, a naphthyl group, a cresyl group, a xylyl group, a mesityl group, a 4-methoxyphenyl group, a 3-chlorophenyl group, a 2,4-dichlorophenyl group, a 4-cyanophenyl group, a 3-methanesulfonamide phenyl group and a 4-methyl sulfonylphenyl group.

When Y represents an amino group, Y is preferably an unsubstituted amino group, an N-alkylamino group or an N,N-dialkylamino group having from 1 to 8 carbon atoms, more preferably an unsubstituted amino group or an N-alkyl amino group having from 1 to 4 carbon atoms, and most preferably an unsubstituted amino group.

When Y represents a dialkylamino group, two amino groups may be bonded to each other to form a 5- to 7-membered ring. As specific examples in this case, listed are a pyrrolidyl group, a piperidyl group, a morpholyl group and the like. Among these groups, a morpholyl group is preferable.

When Y represents an alkoxy group, specific examples of such alkoxy groups include a methoxy group, an ethoxy group, an isopropoxy group, a butoxy group, a tert-butoxy group, an octyloxy group, a hexadecyloxy group, a cyclohexyloxy group, a methoxyethoxy group, a butoxyethoxy group, a phonoxyethoxy group and a 2,4-di-tert-amylphenoxyethoxy group. An alkoxy group having from 1 to 6 carbon atoms is preferable, with a methoxy group, an ethoxy group and a butoxy group being particularly preferable.

When Y represents an aryloxy group, an aryloxy group having from 6 to 12 carbon atoms is more preferable, and a phenoxy group, a cresyloxy group and an anisidyloxy group are listed as specific examples.

When Y represents an acylamino group, an acylamino group having from 1 to 10 carbon atoms is more preferable, and an acetylamino group, a butyloylamino group, a benzoylamino group and the like are listed as illustrative examples.

When Y represents an sulfonamide group, a sulfonamide group having from 1 to 10 carbon atoms is more preferable, and a methane sulfonamide group, a butane sulfonamide group, an octane sulfonamide group, benzene sulfonamide group and the like are listed as representative examples.

When Y represents an alkoxy group, an alkylamino group, a dialkylamino group, an acylamino group and a sulfonamide group, Y and R, may be bonded to each other to form a 5- to 7-membered ring.

Particularly, when Y represents an acylamino group or a sulfonamide group, it is preferable to form a ring, in particular, to form a hydantoin or an oxazoline ring.

Among the compounds according to the invention, an urea and a thiourea are particularly preferable, with an urea being the more preferable.

An amount of the compound according to the invention to be used preferably ranges from 1 mg/M$^2$ to 1 g/m$^2$, more preferably from 10 mg/m$^2$ to 500 mg/m$^2$, and still more preferably from 30 mg/m$^2$ to 300 mg/m$^2$. The compound according to the invention may be used in any layer at a side of a layer containing a photosensitive silver halide; however, the compound according to the invention is preferably used either in a layer containing a photosensitive silver halide or in a layer adjacent thereto.

The compound according to the invention may be added in any state such as an aqueous solution, a solution of an organic solvent such as methanol or the like, a solid dispersion, an emulsion or the like, depending on physical properties of the compound used; however, the compound is preferably added in a state of an aqueous solution or a solid dispersion. When the compound is added in a state of a solid dispersion, a preparation process of the solid dispersion by adding a reducing agent as explained below can be utilized.

Such compounds represented by the general formula (1) according to the invention may be used either singly or in combination of two or more kinds thereof.

Specific examples of the compounds represented by the general formula (1) according to the invention are given below and should not be construed as limiting the invention.

1

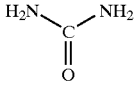

2

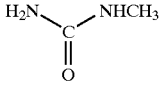

-continued

3

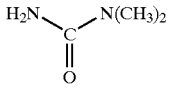

4

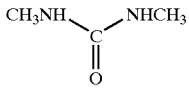

5

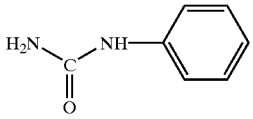

6

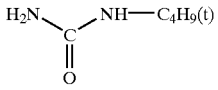

7

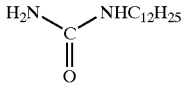

8

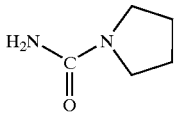

9

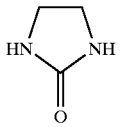

10

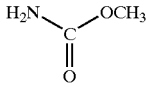

11

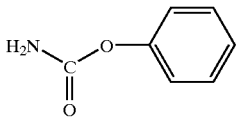

12

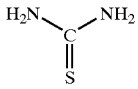

13

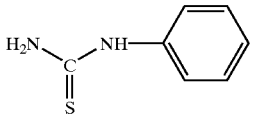

14

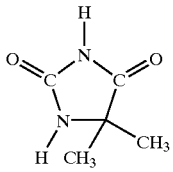

15

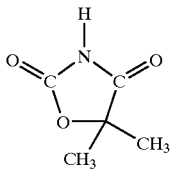

-continued

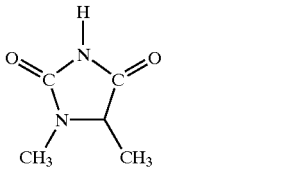

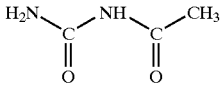

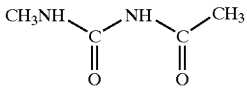

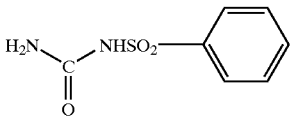

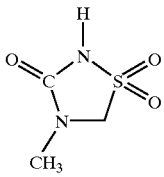

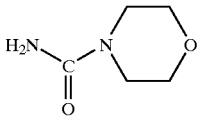

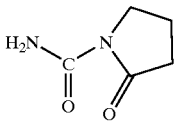

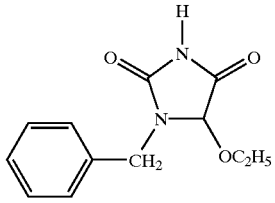

2-1-2. Organic Silver Salt

An organic silver salt usable in the invention is relatively stable against light; however, when heated at 80° C. or higher in the presence of an exposed photosensitive silver halide and a reducing agent, the silver salt should function as a compound to supply a silver ion to form silver images. The organic silver salt may be any organic substance capable of supplying the silver ion, which is reduced by the reducing agent.

Such non-photosensitive organic silver salts are described, for example, in paragraphs [0048] and [0049] of JP-A No. 10-62899, from line 24, page 18 to line 37, page 19 of EP-A No. 0,803,764, EP-A No. 0,962,812, JP-A Nos. 11-349591, 2000-7683 and 2000-72711. Silver salts of organic acids are preferable, and particularly, silver salts of long chain aliphatic carboxylic acids (having carbon atoms of from 10 to 30, and preferably from 15 to 28) are preferable.

Preferable examples of such silver salts of a fatty acid include silver behenate, silver arachidate, silver stearate, silver oleate, silver laurate, silver caproate, silver myristate, silver palmitate, and mixtures thereof. According to the invention, among these silver salts of fatty acids, a silver salt of a fatty acid in which silver behenate is contained in an amount of preferably 50 mol % or more, more preferably 85 mol % or more, and still more preferably 90 mol % or more can preferably be used. Particularly, when an importance is placed on high developing ability, the content of silver behenate is preferably in a range of from 55 mol % to 80 mol %, while when image storability is highly valued, the content thereof is preferably in a range of from 90 mol % to 98 mol %.

The shape of particles of an organic silver salt usable in the present invention is not particularly limited, and may be a needle, rod, plate or flake shape. Preferably, a flaky organic silver salt is used in the present invention. Further, grains in a short acicular shape having a ratio of long to short axes of 5 or less, a rectangular parallelepiped shape, a cubic shape or a potato-like indeterminate shape are favorably used. It is characteristic that such organic silver grains as described above gives lower fog at the time thermal development is performed than a long acicular grain having a ratio of long to short axes of 5 or more does. Particularly, a grain having a ratio of long to short axes of 3 or less is preferable since a mechanical stability of a coated film is enhanced.

Herein, flaky organic silver salts are defined as follows. If the salt is examined through an electron microscope and the shape of the particles is considered to be approximately a rectangular parallelepiped, its sides are named "a", "b" and "c" in an order beginning with the shortest dimension ("c" may be equal to "b"), and the values of the two shortest sides "a" and "b" are used to calculate "x" by the following equation:

$$x=b/a$$

The value "x" is calculated for about 200 particles and if their mean value, $x(\text{mean}) \geqq 1.5$, the particles are defined as flaky. Preferably, $30 \geqq x(\text{mean}) \geqq 1.5$, and more preferably $15 \geqq x(\text{mean}) \geqq 1.5$. Incidentally, the particles are needle-shaped if $1 \leqq x(\text{mean}) < 1.5$.

Side "a" of a flaky particle can be regarded as the thickness of a plate-shaped particle having a principal face defined by sides "b" and "c". The mean value of "a" is preferably from 0.01 to 0.3 $\mu$m, and more preferably from 0.1 to 0.23 $\mu$m. The mean value of c/b is preferably from 1 to 6, more preferably from 1 to 4, still more preferably from 1 to 3, and particularly preferably from 1 to 2.

The particle sizes of the organic silver salt preferably have a monodispersed size distribution. In the monodispersed distribution, the standard deviation of the length of the minor axis or major axis of the particles divided by a length value of the minor axis or major axis, respectively, is preferably not more than 100%, more preferably not more than 80%, and still more preferably not more than 50%. The shape of particles of the salt can be determined from an observed image of a dispersion thereof through a transmission electron microscope. The particle size distribution of the salt can alternatively be determined by employing the standard deviation of the volume weighted mean diameter of the particles, and is monodispersed if a percentage obtained by dividing the standard deviation of the volume weighted mean diameter by the volume weighted mean diameter (coefficient of variation) is not more than 100%, more preferably not more than 80%, and still more preferably not more than 50%.

The particle size (volume weighted mean diameter) can be determined, for example, by applying laser light to the organic silver salt dispersed in a liquid and determining an auto-correlation function of the variation of fluctuation of scattered light with time.

Known methods can be employed to prepare and disperse an organic silver salt usable in the present invention. Reference can be made to, for example, Japanese Patent Application Laid-Open No. 62899/1998, European Patent Laid-Open No. 0803763A1, European Patent Laid-Open No. 0962812A1, Japanese Patent Application Laid-Open Nos. 349591/1999, 7683/2000 and 72711/2000, and Japanese Patent Application Nos. 348228/1999 to 348230/1999, 203413/1999, 90093/2000, 195621/2000, 191226/2000, 213813/2000, 214155/2000 and 191226/2000, etc.

A dispersion of the organic silver salt is preferably substantially free from any photosensitive silver salt, since fogging will be increased and its sensitivity will be greatly lowered. According to the present invention, an aqueous dispersion contains not more than 0.1 mol % of a photosensitive silver salt per 1 mol % of the organic silver salt, and photosensitive silver salt should not be added thereto.

According to the present invention, the organic silver salt may be used in any amount as desired, but preferably in an amount containing 0.1 to 5.0 g/m$^2$, and more preferably 0.3 to 3.0 g/m$^2$, still more preferably 0.5 to 2.0 g/m$^2$ in terms of silver. Particularly, in order to enhance the image storability, the entire silver amount is preferably 1.8 g/m$^2$ or less and more preferably 1.6 g/m$^2$ or less. According to the invention, a sufficient image density can be obtained even at such a low silver amount.

2-1-2. Reducing Agent

The heat development-type photosensitive material of the present invention preferably contains a reducing agent for the organic silver salt. The reducing agent (preferably an organic substance) may be any substance capable of reducing a silver ion to metallic silver. Such reducing agents are described in paragraphs 0043 to 0045 of Japanese Patent Application Laid-Open No. 65021/1999, and page 7, line 34 to page 18, line 12 of European Patent Laid-Open No. 0803764A1.

A preferable reducing agent to be used in the invention is a so-called hindered phenol type reducing agent or a bisphenol type reducing agent which has a substituent at an ortho position of a phenolic hydroxide group. Particularly, a compound represented by the following general formula (R) is preferable:

Formula (R)

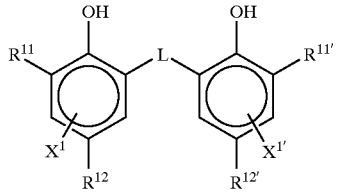

wherein $R^{11}$ and $R^{11'}$ each independently represent an alkyl group having from 1 to 20 carbon atoms;

$R^{12}$ and $R^{12'}$ each independently represent a hydrogen atom or a group capable of being substituent for a benzene ring;

L represents an —S— group or a —CHR$^{13}$-group in which $R^{13}$ represents a hydrogen atom or an alkyl group having from 1 to 20 carbon atoms; and $X^1$ and $X^{1'}$ each independently represent a hydrogen atom or a group capable of being substituent for a benzene ring.

Respective substituents will be described in detail below.

1) $R^{11}$ and $R^{11'}$ $R^{11}$ and $R^{11'}$ each independently represent an alkyl group having from 1 to 20 carbon atoms which may be substituted or unsubstituted. Such substituents are not limited to any specific type, but preferably are an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group, a halogen atom and the like.

2) $R^{12}$ and $R^{12'}$; and $X^1$ and $X^{1'}$ $R^{12}$ and $R^{12'}$ each independently represent a hydrogen atom or a group capable of being substituent for a benzene ring.

$X^1$ and $X^{1'}$ each independently represent a hydrogen atom or a group capable of being substituent for a benzene ring.

Such groups capable of being substituent for a benzene ring are preferably an alkyl group, an aryl group, a halogen atom, an alkoxy group or an acylamino group.

3) L

L represents an —S— group or a —CHR$^{13}$-group, in which $R^{13}$ represents a hydrogen atom or an alkyl group having from 1 to 20 carbon atoms, and the alkyl group may have a substituent.

Specific examples of unsubstituted alkyl groups of $R^{13}$ include a methyl group, an ethyl group, a propyl group, a butyl group, a heptyl group, an undecyl group, an isopropyl group, a 1-ethylpentyl group and a 2,4,4-trimethylpentyl group.

Examples of the substituent of the alkyl group, as same as the substituents in $R^{11}$, include a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group and a sulfamoyl group.

4) Preferable Substituent $R^{11}$ and $R^{11'}$ each independently preferably represent a secondary or tertiary alkyl group having from 3 to 15 carbon atoms. Specific examples of such secondary or tertiary alkyl groups include an isopropyl group, an isobutyl group, a t-butyl group, a t-amyl group, a t-octyl group, a cyclohexyl group, a cyclopentyl group, a 1-methylcyclohexyl group and a 1-methylcyclopropyl group. More preferably, $R^{11}$ and $R^{11'}$ each independently represent a tertiary alkyl group having from 4 to 12 carbon atoms in which, particularly, a t-butyl group and a t-amyl group, with a 1-methylcyclohexyl group being still more preferable, with a t-butyl group being most preferable.

$R^{12}$ and $R^{12'}$ each independently preferably represent an alkyl group having from 1 to 20 carbon atoms. Specific examples of such alkyl groups include a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group and a methoxyethyl group. Among these alkyl groups, a methyl group, an ethyl group, a propyl group, an isopropyl group and a t-butyl group are more preferable.

$X^1$ and $X^{1'}$ each independently preferably represent a hydrogen atom, a halogen atom and an alkyl group, and more preferably a hydrogen atom.

L preferably represents a —CHR$^{13}$-group.

$R^{13}$ preferably represents a hydrogen atom or an alkyl group having from 1 to 15 carbon atoms. Examples of such alkyl groups include a methyl group, an ethyl group, a propyl group, an isopropyl group and a 2,4,4-trimethylpentyl group are preferable. $R^{13}$ particularly preferably represents a hydrogen atom, a methyl group, a propyl group and an isopropyl group.

When $R^{13}$ represents a hydrogen atom, $R^{12}$ and $R^{12'}$ each independently preferably represent an alkyl group having from 2 to 5 carbon atoms, with an ethyl group and propyl group being preferable, and an ethyl group being most preferable.

When $R^{13}$ represents a primary or secondary alkyl group having from 1 to 8 carbon atoms, $R^{12}$ and $R^{12'}$ each independently preferably represent a methyl group. As examples of such a primary or secondary alkyl group each having from 1 to 8 carbon atoms of $R^{13}$, a methyl group, an ethyl group, a propyl group and an isopropyl group are more preferable. Among them, a methyl group, an ethyl group and a propyl group are still more preferable.

When $R^{11}$ and $R^{11'}$, and $R^{12}$ and $R^{12'}$ each independently represent a methyl group, $R^{13}$ preferably represents a secondary alkyl group. In this case, as such a secondary alkyl group of $R^{13}$, an isopropyl group, an isobutyl group and a 1-ethylpentyl group are preferable, with an isopropyl group being more preferable.

The above-described reducing agents differ in thermally developing performance depending on combinations of $R^{11}$, $R^{11'}$ and $R^{12}$ and $R^{12'}$ and $R^{13}$. Since the thermally developing performance of reducing agents can be adjusted by simultaneously using two or more kinds of reducing agents at various mixing ratios, it is preferable that reducing agents are used in combination of two or more kinds thereof depending on the purposes.

Specific examples of the reducing agent used in the invention including the compounds represented by the general formula (R) are given below, but it should not be construed as limiting the invention.

(R-1)

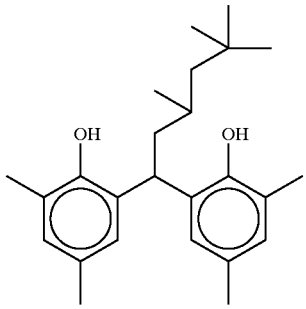

(R-2)

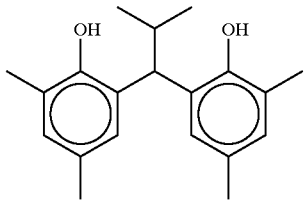

(R-3)

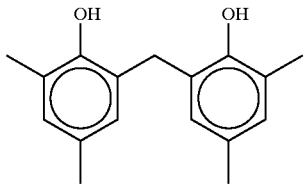

-continued (R-4)

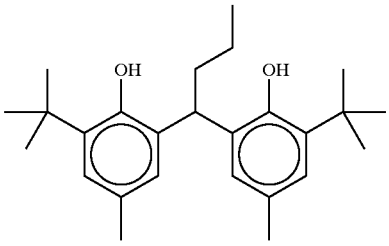

(R-5)

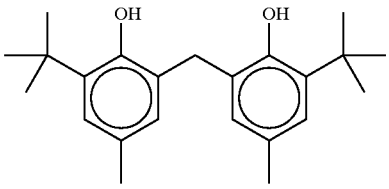

(R-6)

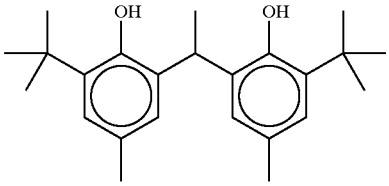

(R-7)

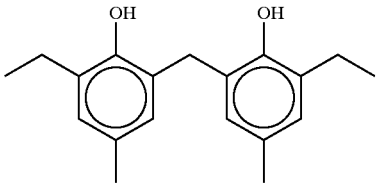

(R-8)

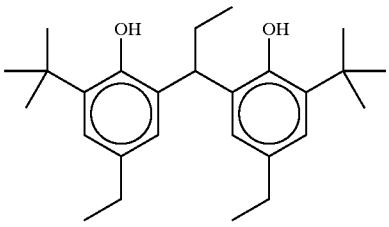

(R-9)

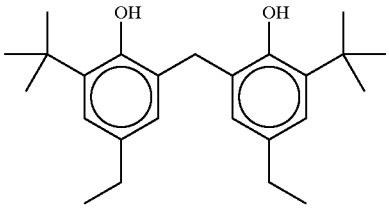

(R-10)

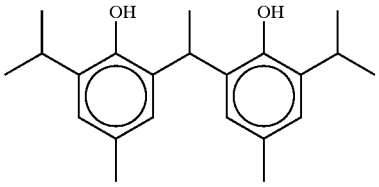

-continued
(R-11)
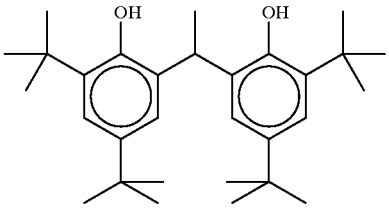
(R-12)
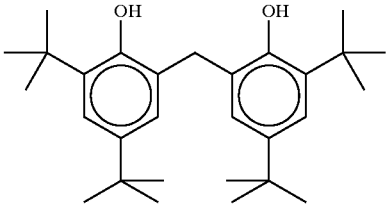
(R-13)
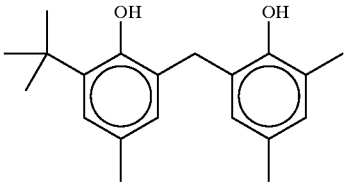
(R-14)
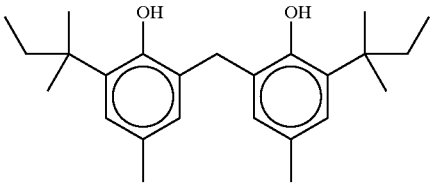
(R-15)
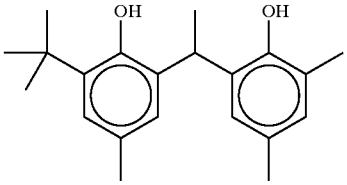
(R-16)
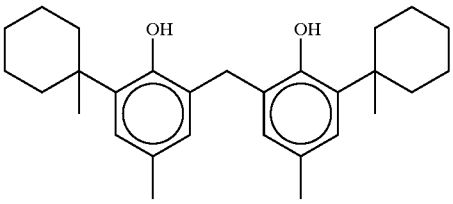
(R-17)
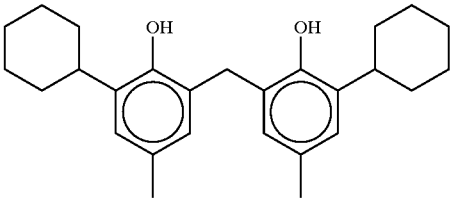
-continued
(R-18)
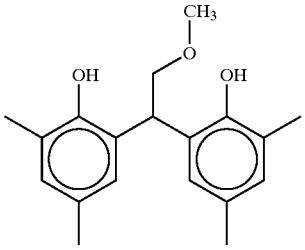
(R-19)
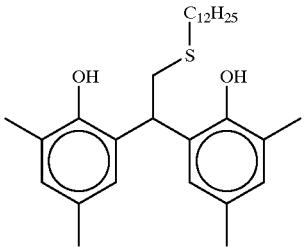
(R-20)
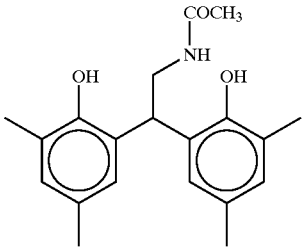
(R-21)
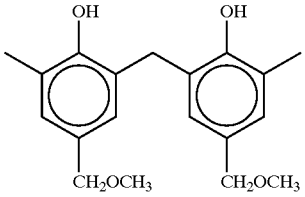
(R-22)
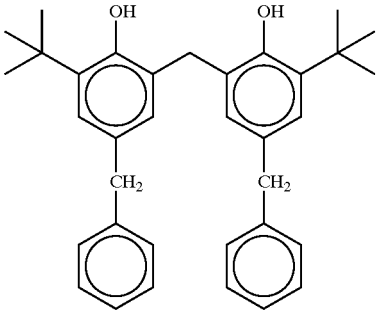
(R-23)
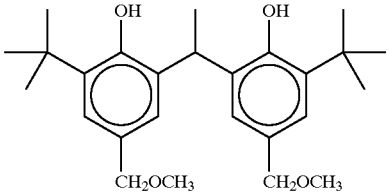

-continued (R-24)

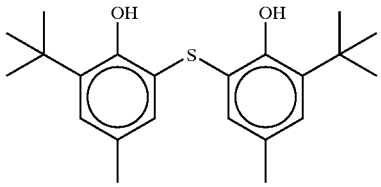

(R-25)

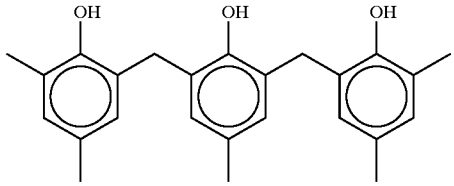

(R-26)

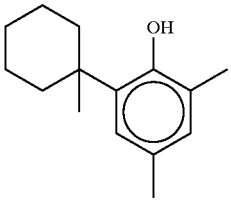

(R-27)

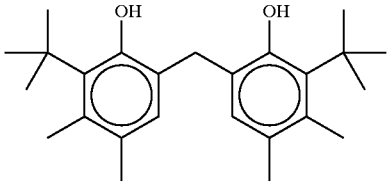

(R-28)

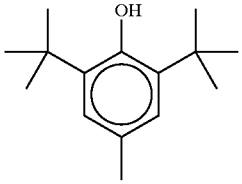

(R-29)

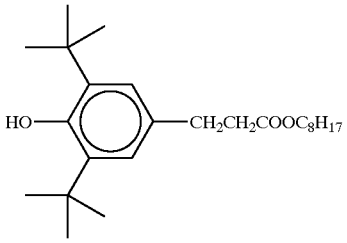

(R-30)

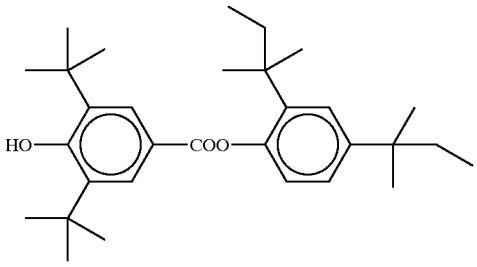

-continued (R-31)

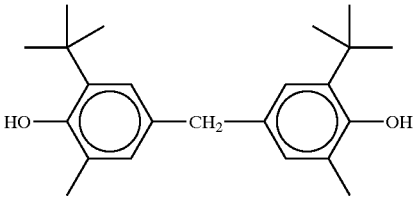

(R-32)

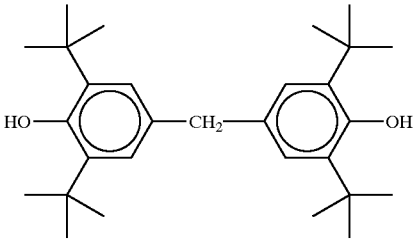

(R-33)

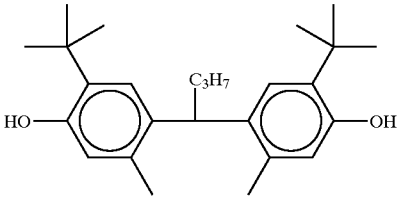

(R-34)

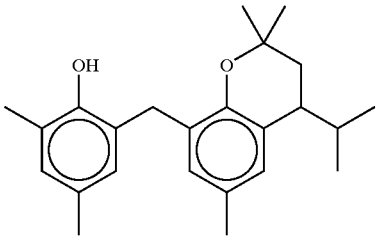

An addition amount of the reducing agent used in the invention is preferably from 0.1 g/m$^2$ to 3.0 g/m$^2$, more preferably from 0.2 g/m$^2$ to 1.5 g/m$^2$, and still more preferably from 0.3 g/m$^2$ to 1.0 g/m$^2$. A content thereof is preferably from 5 mol % to 50 mol % relative to 1 mol of silver present on a surface having an image-forming layer, more preferably from 8 mol % to 30 mol %, and still more preferably from 10 mol % to 20 mol %.

The reducing agent used in the invention can be added to the image-forming layer that contains the organic silver salt and the photosensitive silver halide as well as an adjacent layer thereto. Preferably, the reducing agent is preferably incorporated in the image-forming layer.

The reducing agent used in the invention is contained in a coating solution in any form, for example, a solution form, a emulsified dispersion form or a solid microparticle dispersion form, so as to be incorporated in the thermally developable photosensitive material.

As a well known emulsifying and dispersing method, employable is a method to dissolve the reducing agent using oil such as dibutyl phthalate, tricresyl phosphate, glyceryl triacetate and diethyl phthalate, or an auxiliary solvent such as ethyl acetate and cyclohexanone to thereby mechanically prepare an emulsified dispersion.

Further, as a solid microparticle dispersing method, employable is a method to disperse the reducing agent in an appropriate solvent such as water using a ball mill, a colloid mill, a vibrating ball mill, a sand mill, a jet mill, a roller mill or ultrasonic waves to thereby prepare a solid dispersion. The reducing agent is preferably dispersed through the method using the sand mill. In this case, a protective colloid (e.g, polyvinyl alcohol), a surfactant (e.g., an anionic surfactant such as sodium triisopropylnaphthalene sulfonate: a mixture of isomers which differs in substituted positions of three isopropyl groups from one another) may be used. Further, an antiseptic agent (e.g., benzoisothiazolinone sodium salt) may be contained in an aqueous dispersion.

Among the above methods, the method of dispersing solid microparticles of the reducing agent is particularly preferable. The reducing agent is preferably added in form of microparticles having an average particle size of from 0.01 $\mu$m to 10 $\mu$m, preferably from 0.05 $\mu$m to 5 $\mu$m, and more preferably from 0.1 $\mu$m to 2 $\mu$m. In the invention, other solid dispersions are preferably prepared such that the solids contained therein have the above-described range of particle size.

2-1-3. Developing Accelerator

In the thermally developable photosensitive material according to the invention, a sulfonamide phenol type compound represented by the general formula (A) described in JP-A Nos. 2000-267222, 2000-330234 and the like, a hindered phenol type compound represented by the general formula (II) described in JP-A No. 2001-92075, a hydrazine type compound represented by the general formula (I) described in JP-A Nos. 10-62895, 11-15116 and the like, or represented by the general formula (1) described in Japanese Patent Application No. 2001-074278, or a phenol type or naphthol type compound represented by the general formula (2) described in Japanese Patent Application No. 2000-76240 are preferably used as the developing accelerator. Such developing accelerators are used, relative to the reducing agent, in a range of from 0.1 mol % to 20 mol %, preferably from 0.5 mol % to 10 mol %, and more preferably from 1 mol % to 5 mol %. A method for introducing the thermally developable photosensitive material is the same as that used for the reducing agent. Particularly, an addition thereof as a solid dispersion or an emulsified dispersion is preferable. When the developing accelerator is added as the emulsified dispersion, it is preferably added either as the emulsified dispersion prepared using a high boiling-point solvent which is solid at normal temperature and a low boiling-point auxiliary solvent or as a so-called oil-less emulsified dispersion prepared without using a high boiling-point solvent.

In the invention, among developing accelerators described above, the hydrazine type compound represented by the general formula (1) described in Japanese Patent Application No. 2001-074278 and the phenol type or naphthol type compound represented by the general formula (2) described in Japanese Patent Application No. 2000-76240 are particularly preferable.

Specific preferred examples of the developing accelerators used in the invention are given below, but it should not be construed as limiting the invention.

(A-1)

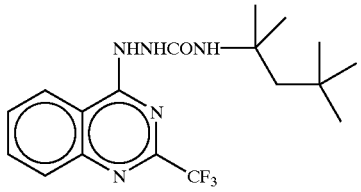

(A-2)

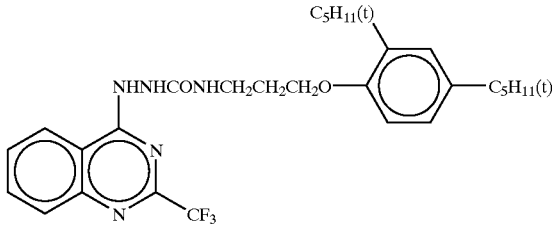

(A-3)

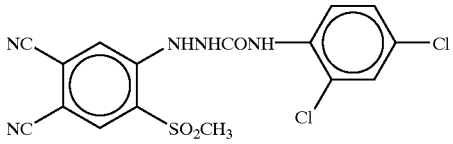

(A-4)

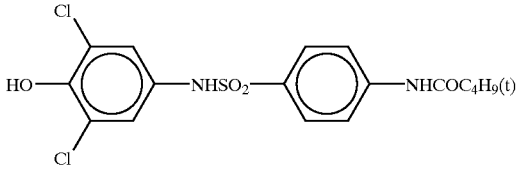

(A-5)

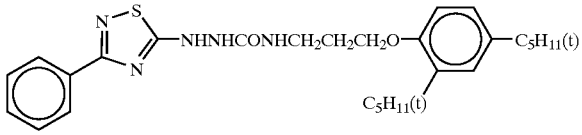

(A-6)

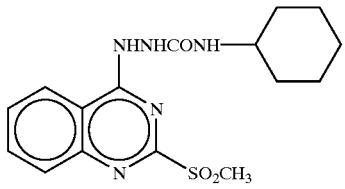

(A-7)

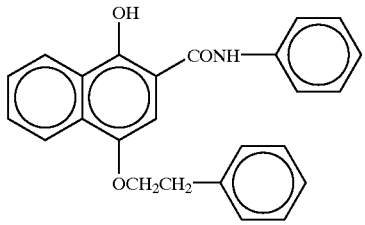

(A-8)

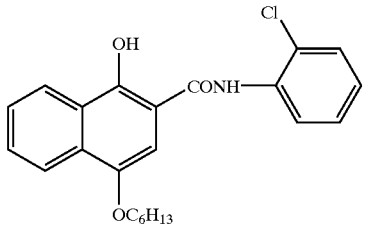

-continued (A-9)

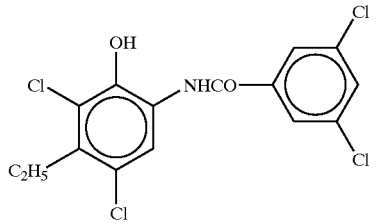

(A-10)

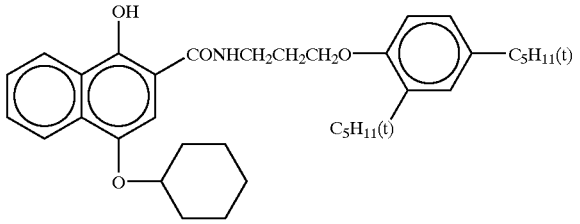

2-1-4. Hydrogen Bond-Forming Compound

In the invention, it is preferable to simultaneously use a non-reducing compound having a group capable of forming a hydrogen bond with an aromatic hydroxyl group (—OH) of the reducing agent.

The group of the compound capable of forming a hydrogen bond includes, for example, a phosphoryl group, a sulfoxido group, a sulfonyl group, a carbonyl group, an amido group, an ester group, an urethane group, an ureido group, a tertiary amino group, and a nitrogen-containing aromatic group. Among these, preferred are compounds having any of a phosphoryl group, a sulfoxido group, an amido group (not having >N—H group but blocked like >N—R, in which R is a substituent except H), an urethane group (not having >N—H group but blocked like >N—R, in which R is a substituent except H), an ureido group (not having >N—H group but blocked like >N—R, in which R is a substituent except H).

Particularly preferable hydrogen bond-forming compounds for use in the present invention are those represented by the following formula (A):

Formula (A)

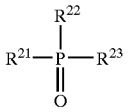

In formula (A), $R^{21}$ to $R^{23}$ each independently represent an alkyl group, an aryl group, an alkoxy group, an aryloxy group, an amino group or a heterocyclic group, which may be unsubstituted or substituted.

When $R^{21}$ to $R^{23}$ have substituents, examples of the substituents include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group, and a phosphoryl group. Among these, preferred are an alkyl group and an aryl group. Specifically, methyl, ethyl, isopropyl, tert-butyl, tert-octyl, phenyl, 4-alkoxyphenyl and 4-acyloxyphenyl groups are listed.

Examples of the groups represented by $R^{21}$ to $R^{23}$ include an alkyl group such as methyl, ethyl, butyl, octyl, dodecyl, isopropyl, tert-butyl, tert-amyl, tert-octyl, cyclohexyl, 1-methylcyclohexyl, benzyl, phenethyl and 2-phenoxypropyl groups; an aryl group such as phenyl, cresyl, xylyl, naphthyl, 4-tert-butylphenyl, 4-tert-octylphenyl, 4-anisidyl and 3,5-dichlorophenyl groups; an alkoxyl group such as methoxy, ethoxy, butoxy, octyloxy, 2-ethylhexyloxy, 3,5,5-trimethylhexyloxy, dodecyloxy, cyclohexyloxy, 4-methylcyclohexyloxy and benzyloxy groups; an aryloxy group such as phenoxy, cresyloxy, isopropylphenoxy, 4-tert-butylphenoxy, naphthoxy and biphenyloxy groups; an amino group such as amino, dimethylamino, diethylamino, dibutylamino, dioctylamino, N-methyl-N-hexylamino, dicyclohexylamino, diphenylamino and N-methyl-N-phenylamino groups.

For $R^{21}$ to $R^{23}$, preferred are an alkyl group, an aryl group, an alkoxy group and an aryloxy group. In view of the effects of the present invention, at least one of $R^{21}$ to $R^{23}$ is preferably an alkyl group or an aryl group. More preferably, at least two of them are an alkyl or an aryl group. Even more preferably, $R^{21}$ to $R^{23}$ are the same group in view of inexpensiveness of the compounds available.

Specific examples of the compound of formula (A) are listed below, however, the compounds employable in the present invention are not limited thereto.

(D-1)

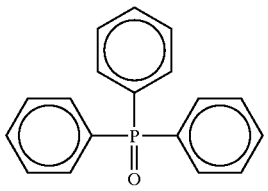

(D-2)

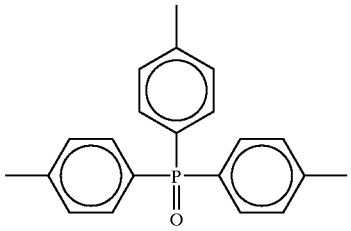

(D-3)

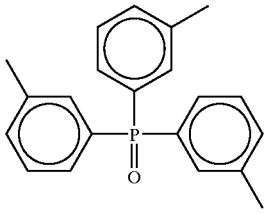

(D-4)

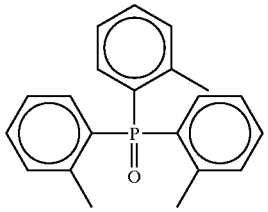

-continued (D-5)

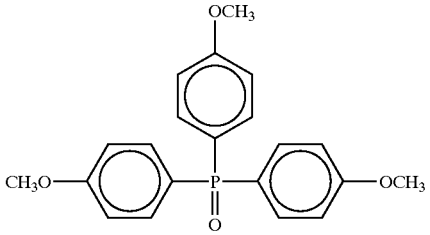

(D-6)

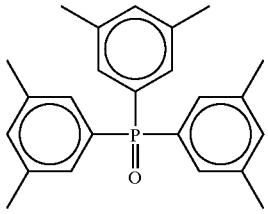

(D-7)

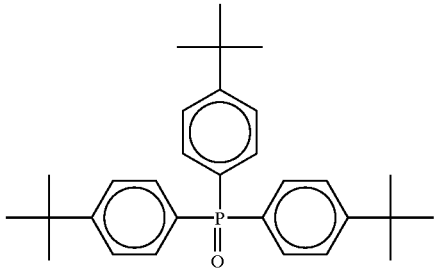

(D-8)

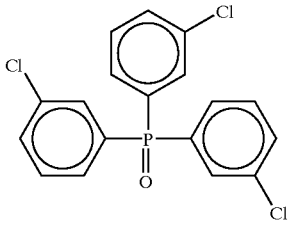

(D-9)

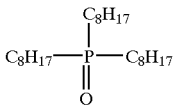

(D-10)

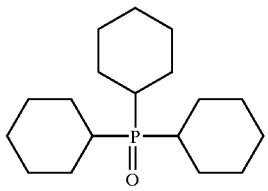

(D-11)

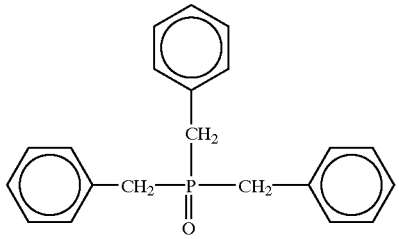

-continued (D-12)

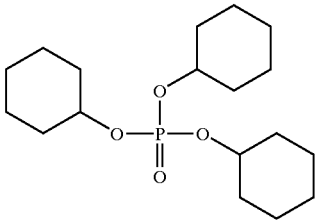

(D-13)

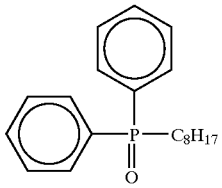

(D-14)

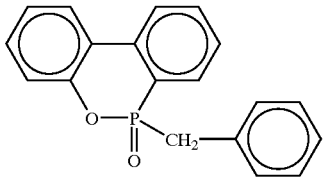

(D-15)

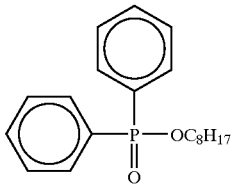

(D-16)

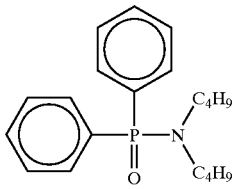

(D-17)

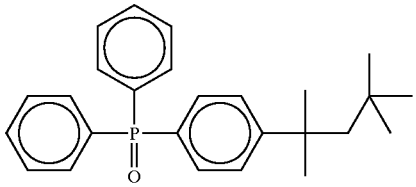

(D-18)

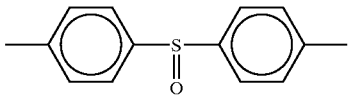

Other examples of the hydrogen bond-forming compounds than the above-shown examples include those described in Japanese Patent Application Nos. 2000-192191 and 2000-194811.

Like the reducing agent, the hydrogen bond-forming compound may be included in a coating solution for producing the thermally developable photosensitive material of the present invention in any form of, for example, a solution, an emulsified dispersion or a dispersion of solid microparticles. While present in the form of a solution, the hydrogen bond-forming compound forms a hydrogen-bonding complex with a compound having a phenolic hydroxyl group or an amino group. Depending on the combination with a reducing agent and a hydrogen bond-forming compound (A), the complex can be isolated as crystals.

Use of a powder in the form of the thus-isolated crystals to form a dispersion of solid microparticles of the hydrogen bond-forming compound is especially preferred from the standpoint of achieving stable performances. Also preferably used is a method of mixing the reducing agent and the hydrogen bond-forming compound both in the form of a powder, followed by milling the resulting mixture together with a suitable dispersant in a sand grinder mill or the like to thereby form a complex while present in the form of a dispersion.

The amount of the hydrogen bond-forming compound to be used preferably falls between 1 and 200 mol %, more preferably between 10 and 150 mol %, and even more preferably between 30 and 100 mol % relative to the amount of the reducing agent used.

2-1-5. Photographic Silver Halide Emulsion

1) Silver Halide Composition and Form

The halogen composition of the photosensitive silver halide grains for use in the present invention is not specifically limited, and there may be used silver chloride, silver chlorobromide, silver bromide, silver iodobromide, silver iodochlorobromide. Regarding the halide distribution in individual grains, the halide may be uniformly distributed throughout the grain, or may stepwise distributed, or may continuously distributed. Silver halide grains having a core/shell structure are preferably used. Preferably, the core/shell structure of the grains has 2 to 5 layers, more preferably 2 to 4 layers. Also a technique to localize silver bromide on the surface of silver chloride or silver chlorobromide grains is preferably employed.

Methods of forming photosensitive silver halides are well known in the art and may be employed in the present invention, for example, as described in Research Disclosure No. 17029 (June 1978), and U.S. Pat. No. 3,700,458. More specifically, a silver source-supplying compound and a halogen source-supplying compound are added to a solution of gelatin or any other polymer to prepare a photosensitive silver halide, followed by admixing with an organic silver salt. Further, the method described in JP-A No.11-119374, paragraphs [0217] to [0244]; and the methods described in JP-A Nos.11-98708 and 2000-347335 are also preferable.

The photosensitive silver halide grains preferably have a smaller size in order to prevent the formed images from becoming cloudy. Specifically, the size is preferably at most 0.20 $\mu$m, more preferably falling between 0.01 $\mu$m and 0.15 $\mu$m, and even more preferably between 0.02 $\mu$m and 0.12 $\mu$m. The grain size as used herein refers to the diameter of the circular image having the same area as the projected area of each silver halide grain (for tabular grains, the main face of each grain is projected to determine the projected area of the grain).

Silver halide grains may have various shapes including, for example, cubic grains, octahedral grains, tabular grains, spherical grains, rod-like grains, and potato-like grains. Cubic silver halide grains are especially preferred for use in the present invention. Also preferred are roundish silver halide grains with their corners rounded.

The surface index (Miller index) of the outer surface of the photosensitive silver halide grains for use in the present invention is not specifically limited, but it is preferred that the proportion of {100} plane, which ensures higher spectral sensitization when it has adsorbed a color-sensitizing dye, in the outer surface is large. Preferably, the proportion of {100} plane is at least 50%, more preferably at least 65%, and even more preferably at least 80%. The Miller index expressed by the proportion of {100} plane can be obtained according to the method described in *J. Imaging Sci.*, written by T. Tani, 29, 165 (1985), based on the adsorption dependency of {111} plane and {100} plane for sensitizing dyes.

2) Heavy Metal

Silver halide grains having a hexacyano-metal complex in their outermost surface are preferred for use in the present invention. The hexacyano-metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. The hexacyano-Fe complexes are preferably used in the present invention.

As hexacyano-metal complexes exist in the form of ions in their aqueous solutions, their counter cations are of no importance. However, it is preferable to use as the counter cation any of alkali metal ions such as sodium ion, potassium ion, rubidium ion, cesium ion and lithium ion; ammonium ion, and alkylammonium ion (e.g., tetramethylammonium ion, tetraethylammonium ion, tetrapropylammonium ion and tetra(n-butyl)ammonium ion) due to good water miscibility and easy handling of silver halide emulsion sedimentation.

The hexacyano-metal complex may be added in the form of a solution thereof in water or in a mixed solvent of water and an organic solvent miscible with water (for example, alcohols, ethers, glycols, ketones, esters, amides), or in the form of a mixture with gelatin.

The amount of the hexacyano-metal complex to be added preferably falls between $1\times10^{-5}$ mols and $1\times10^{-2}$ mols, per mol of silver, and more preferably between $1\times10^{-4}$ mols and $1\times10^{-3}$ mols.

In order to make the hexacyano-metal complex exist in the outermost surface of silver halide grains, addition of the complex is conducted in the charging step, i.e., after an aqueous silver nitrate solution to form silver halide grains has been added to a reaction system but before the grains having formed are subjected to chemical sensitization such as chalcogen sensitization with sulfur, selenium or tellurium or noble metal sensitization with gold or the like, or alternatively the complex is directly added to the grains in the step of rinsing, dispersing or prior to conducting chemical sensitization. In order to prevent the silver halide grains from excessively growing, it is desirable to add the hexacyano-metal complex to the grains immediately after they are formed, and preferably before the charging step is completed.

Addition of the hexacyano-metal complex to silver halide grains may be started after 96% by mass of the total of silver nitrate for forming the grains has been added to a reaction system, but is preferably started after 98% by mass of silver nitride has been added thereto, more preferably after 99% by mass thereof has been added thereto.

The hexacyano-metal complex, when added to silver halide grains after an aqueous solution of silver nitrate has been added to the reaction system but just before the grains are completely formed, can be adsorbed by the grains formed to exist on the outermost surface thereof. Most of the complex thus added can form hardly-soluble salts with the silver ions present on the surface of the grains. Since the silver salt of hexacyano-iron(II) is more hardly soluble than AgI, fine grains are prevented from re-dissolving. Consequently, fine silver halide grains having a small grain size can be produced.

The photosensitive silver halide grains for use in the present invention may contain a metal or metal complex of Groups VIII to X of the Periodic Table (including Groups I to XVIII). As the metal or the central metal of metal complex of Groups VIII to X, preferably used is rhodium, ruthenium or iridium. In the present invention, one metal complex may be used alone, or two or more metal complexes of the same species or different species of metals may be used in combination. The metal or metal complex content of the grains preferably falls between $1\times10^{-9}$ mols and $1\times10^{-3}$ mols per mol of silver. Such heavy metals and metal complexes, and methods of adding them to silver halide grains are described in, for example, JP-A No.7-225449, JP-A No.11-65021, paragraphs [0018] to [0024], and JP-A No. 11-119374, paragraphs [0227] to [0240].

The metal atoms (e.g., $[Fe(CN)_6]^{4-}$) that may be included to the silver halide grains for use in the present invention, as well as the methods of desalting or chemical sensitization of the silver halide emulsions are described, for example, in JP-A No.11-84574, paragraphs [0046] to [0050], JP-A No.11-65021, paragraphs [0025] to [0031], and JP-A No.11-119374, paragraphs [0242] to [0250].

3) Gelatin

Various kinds of gelatins may be used for preparing the photosensitive silver halide emulsions for use in the present invention. In order to sufficiently disperse the photosensitive silver halide emulsion in a coating solution containing an organic silver salt, preferably used is a low-molecular gelatin having a molecular weight of from 10,000 to 1000,000. The phthalated gelatin is preferably used. The low-molecular gelatin may be used when forming the silver halide grains or when dispersing the grains after the grains have been desalted. Preferably, it is used when dispersing the grains after they have been desalted.

4) Sensitizing Dye

In the present invention, sensitizing dyes may be used to sensitize the photosensitive silver halide. Usable as the sensitizing dyes, preferably selected are those which, after adsorbed by silver halide grains, can spectrally sensitize the grains within a desired wavelength range and have spectral sensitivity suitable for the light source to be used for exposure. Details of sensitizing dyes and methods for adding them to the thermally developable photosensitive material of the present invention, reference are made to paragraphs [0103] to [0109] in JP-A No.11-65021; compounds of formula (II) in JP-A No.10-186572; dyes of formula (I) and paragraph [0106] in JP-A No.11-119374; dyes described in U.S. Pat. Nos. 5,510,236 and 3,871,887 (Example 5); dyes described in JP-A Nos.2-96131 and 59-48753; from page 19, line 38 to page 20, line 35 in EP No.0803764A1; JP-A Nos.2000-86865 and 2000-102560. These sensitizing dyes may be used herein either singly or in combination of two or more. Regarding the time at which the sensitizing dye is added to the silver halide emulsion in the present invention, it is desirable that the sensitizing dye is added thereto after the desalting step but before the coating step, more preferably after the desalting step but before the chemical ripening step.

The amount of the sensitizing dye to be included in the thermally developable photosensitive material of the present invention varies as desired, depending on the sensitivity and the fogging properties of the material. In general, it preferably falls between $10^{-6}$ and 1 mol, more preferably between $10^{-4}$ and $10^{-1}$ mols, per mol of the silver halide in the image-forming layer of the material.

In order to improve spectral sensitization, a supersensitizer may be used in the present invention. For the supersensitizer, for example, usable are the compounds described in EP No.587,338, U.S. Pat. Nos. 3,877,943, 4,873,184, and JP-A Nos.5-341432, 11-109547 and 10-111543.

5) Chemical Sensitization

Preferably, the photosensitive silver halide grains for use in the present invention are chemically sensitized with, for example, sulfur, selenium or tellurium. For such sulfur, selenium or tellurium sensitization, any known compounds are usable. For example, preferred are the compounds described in JP-A No.7-128768. Tellurium sensititization is preferably conducted in the present invention, by using the compounds described in JP-A No.11-65021, paragraph [0030], and the compounds of formulae (II), (III) and (IV) given in JP-A No.5-313284.

It is preferable that the photosensitive silver halide according to the invention is chemically sensitized by a gold sensitization method either alone or in combination with the above-described chalcogen sensitization. As for a gold sensitizer, an oxidation number of gold is preferably either 1 or 3 and such gold sensitizers are preferably gold compounds commonly used as a gold-sensitizer. As for illustrative examples thereof, chloroauric acid, potassium chloroaurate, potassium bromoaurate, auric trichloride, potassium auric thiocyanate, potassium iodoaurate, tetracyanoauric acid, ammonium aurothiocyanate, and pyridyltrichloro gold are preferable. Further, gold sensitizers described in U.S. Pat. No. 5,858,637 and Japanese Patent Application No. 2001-79450 also can preferably be used.

In the present invention, the silver halides may be chemically sensitized in any stage after their formation but before their coating. For example, they may be chemically sensitized after desalted, but (1) before spectral sensitization, or (2) along with spectral sensitization, or (3) after spectral sensitization, or (4) just before coating. Especially preferably, the grains are chemically sensitized after spectral sensitization.

The amount of the sulfur, selenium or tellurium sensitizer for such chemical sensitization varies, depending on the type of the silver halide grains to be sensitized therewith and the condition for chemically ripening the grains, but may fall generally between $10^{-5}$ and $10^{-2}$ mols, preferably approximately between $10^{-7}$ and $10^{-3}$ mols, per mol of the silver halide.

An amount of the gold sensitizer to be added varies depending on various types of conditions; however, the amount thereof is approximately in a range of from $10^{-7}$ mol to $10^{-3}$ mol and preferably from $10^{-5}$ mol to $5\times10^{-4}$ mol per mol of the silver halide.

Though not specifically limited, the condition for chemical sensitization may be such that the pH falls between 5 and 8, the pAg falls between 6 and 11, and the temperature falls approximately between 40 and 95° C. or so.

If desired, a thiosulfonic acid compound may be added to the silver halide emulsions for use in the present invention, according to the method described in EP No.293,917.

The photosensitive silver halide grains used in the invention may be subjected to reductive sensitization. As for such reductive sensitizers, ascorbic acid and thiourea dioxide are preferable and, as other reductive sensitizers than these reductive sensitizers, stannous chloride, aminoiminomethane sulfonic acid, a hydrazine derivative, a borane compound, a silane compound, a polyamine compound and the like can preferably be used. An addition of the reductive sensitizer may be performed at any stage of a photosensitive emulsion production process of from crystalline growth to a preparation process until immediately before coating. Further, the reductive sensitization is preferably performed by ripening the grains while keeping the emulsion at pH 7 or above, or at pAg 8.3 or below; also, the reductive sensitization is preferably performed by introducing a single addition portion of silver ion during the formation of the grains.

The photosensitive silver halide used in the invention preferably contains an FED sensitizer (Fragmentable electron donating sensitizer) as a compound that generates two electrons by one photon. As the FED sensitizer, compounds described in U.S. Pat. Nos. 5,747,235, 5,747,236, 6,054,260 and 5,994,051 and Japanese Patent Application No. 2001-86161 are preferably used. An addition of the FED sensitizer may be performed at any stage of a photosensitive emulsion production process of from crystalline growth to a preparation process until immediately before coating. An amount of the FED sensitizer to be added varies depending on various types of conditions; however, it is regarded approximate if the amount thereof ranges from $10^{-7}$ mol to $10^{-1}$ mol, and preferably ranges from $10^{-6}$ mol to $5\times10^{-2}$ mol per mol of the silver halide.

6) Simultaneous Use of a Plurality of Silver Halides

The photosensitive material according to the present invention may contain a single kind or two or more kinds of photosensitive silver halide grains (these may differ in their mean grain size, halogen composition or crystal habit, or in the condition for their chemical sensitization), either alone or in combination. Combining two or more kinds of photosensitive silver halide grains differing in their sensitivity enables to control the gradation of the thermally developable photosensitive material. The techniques relating thereto are described in JP-A NOs.57-119341, 53-106125, 47-3929, 48-55730, 46-5187, 50-73627 and 57-150841. The sensitivity difference between silver halide emulsions to be mixed is at least 0.2 logE.

7) Coating Amount of Silver Halide

The amount of the photosensitive silver halide grains is preferably from 0.03 to 0.6 g/m$^2$, more preferably from 0.05 to 0.4 g/m$^2$, and most preferably from 0.07 to 0.3 g/m$^2$, in terms of the coating amount of silver per m$^2$ of the thermally developable photosensitive material. Per mol of the organic silver salt, photosensitive silver halide grains to be used preferably falls between 0.01 mol and 0.5 mol, more preferably between 0.02 mol and 0.3 mol, and still more preferably between 0.03 mol and 0.2 mol.

8) Mixing of Silver Halide and Organic Silver Salt, and Mixing of Coating Solution Regarding the methods and the conditions for admixing the photosensitive silver halide grains with an organic silver salt having been prepared separately, employable is a method of mixing them in a high-performance stirrer, a ball mill, a sand mill, a colloid mill, a shaking mill, a homogenizer or the like; or a method of adding the photosensitive silver halide grains having been prepared to an organic silver salt in any desired timing to produce the organic silver salt. However, there is no specific limitation thereto, insofar as the methods employed provide the advantages of the present invention. Mixing two or more kinds of aqueous organic silver salt dispersions with two or more kinds of aqueous photosensitive silver salt dispersions is preferably conducted in order to suitably control the photographic properties.

The preferred point at which the silver halide grains are added to the coating solution to form an image-forming layer may fall between 180 minutes before coating the liquid and a time just before the coating, preferably between 60 minutes and 10 seconds before the coating. However, there is no specific limitation thereto, insofar as the methods and the conditions employed for adding the grains to the coating solution provide the advantages of the present invention. Specific mixing methods include, for example, a method of mixing the grains with the coating solution in a tank in such a controlled manner that the mean dwelling time, as calculated from an adding flow rate and a supplying flow rate to a coater, will fall within a predetermined duration; or a method of mixing them by means of a static mixer, for example, as described in "*Liquid Mixing Technology*" written by N. Harunby, M. F. Edwards & A. W. Nienow, Chap. 8 (translated by Koji Takahasi, published by Nikkan Kogyo Shinbun, 1989).

2-1-6. Binder

The binder to be contained in the photosensitive layer in the thermally developable photosensitive material of the present invention may be a polymer of any type, but is preferably transparent or semitransparent and is generally colorless. Preferable examples of the binder are natural resins, polymers and copolymers; synthetic resins, polymers and copolymers; and other film-forming media. More specifically, they include, for example, gelatins, rubbers, poly(vinyl alcohols), hydroxyethyl celluloses, cellulose acetates, cellulose acetate butyrates, poly(vinylpyrrolidones), casein, starch, poly(acrylic acids), poly(methyl methacrylates), poly(vinyl chlorides), poly(methacrylic acids), styrene/maleic anhydride copolymers, styrene/acrylonitrile copolymers, styrene/butadiene copolymers, poly(vinylacetals) (e.g., poly(vinylformal) and poly(vinylbutyral)), poly(esters), poly(urethanes), phenoxy resins, poly(vinylidene chlorides), poly(epoxides), poly(carbonates), poly(vinyl acetates), poly(olefins), cellulose esters, and poly(amides). A coating layer is formed from an aqueous solution, a solution in an organic solvent or an emulsion of the binder.

1) Glass Transition Point (Tg)

The glass transition point of the binder to be included in the organic silver salt-containing layer in the present invention preferably falls between −20° C. and 80° C., more preferably between 0° C. and 70° C., even more preferably between 10° C. and 65° C.

As used herein, Tg is calculated according to the following equation:

$$1/Tg=\Sigma(Xi/Tgi)$$

The polymer whose glass transition point Tg is calculated as above comprises n's monomers copolymerized (i indicates the number of the monomers copolymerized, falling between 1 and n); Xi indicates the mass fraction of i'th monomer ($\Sigma Xi=1$); Tgi indicates the glass transition point (in terms of the absolute temperature) of the homopolymer of i'th monomer alone; and $\Sigma$ indicates the sum total of i falling between 1 and n. Incidentally, the value of glass transition point (Tgi) of the homopolymer of each monomer alone is adopted from the values described in "*Polymer Handbook*" (3rd edition) (written by J. Brandrup, E. H. Immergut (Wiley-Interscience, 1989)).

A single kind of polymer may be used for the binder, or alternatively, two or more kinds of polymers may be used in combination. For example, a combination of a polymer having a glass transition point of higher than 20° C. and another polymer having a glass transition point of lower than 20° C. is possible. In case where at least two kinds of polymers that differ in Tg are blended for use therein, it is desirable that the mass-average Tg of the resulting blend falls within the ranges specified as above.

2) Aqueous Coating

In case where the organic silver salt-containing layer is formed by applying a coating solution in which at least 30% by mass of the solvent is water, followed by drying, and in case where the binder to be included in the organic silver salt-containing layer is soluble or dispersible in an aqueous solvent (watery solvent), and especially when the binder to be included in the organic silver salt-containing layer is a polymer latex having an equilibrium water content of at most 2% by mass at 25° C. and 60% RH, the thermally developable photosensitive material achieves improved properties.

Most preferably, the binder for use in the present invention has ionic conductivity at most 2.5 mS/cm. In order to prepare such a binder, employable is a method of preparing a polymer followed by purification through a functional membrane for separation.

The aqueous solvent as used herein in which the polymer binder is soluble or dispersible in water or a mixture of water and at most 70% by mass of a water-miscible organic solvent.

The water-miscible organic solvent includes, for example, alcohols such as methyl alcohol, ethyl alcohol, propyl alcohol; cellosolves such as methyl cellosolve, ethyl cellosolve, butyl cellosolve; ethyl acetate, and dimethylformamide.

The term "equilibrium water content at 25° C. and 60% RH" as used herein is represented by the following equation, in which $W^1$ indicates the mass of a polymer in humidity-conditioned equilibrium at 25° C. and 60% RH, and $W^0$ indicates the absolute dry mass of the polymer at 25° C.

$$\text{Equilibrium water content at 25° C. and 60\% RH} = \{(W^1 - W^0)/W^0\} \times 100 \text{ (\% by mass)}$$

For the details of the definition of water content and the method for measuring it, for example, referred to is "*Lecture of High Polymer Engineering*", No.14, Test Methods for High Polymer Materials (by the Society of High Polymer of Japan, Chijin Shokan).

Preferably, the equilibrium water content at 25° C. and 60% RH of the binder polymer for use in the present invention is at most 2% by mass, more preferably from 0.01 to 1.5% by mass, even more preferably from 0.02 to 1% by mass.

Polymers for use in the present invention are preferably dispersible in aqueous solvents. Preferable polymer dispersions include, for example, a polymer latex in which water-insoluble hydrophobic polymer microparticles are dispersed, a dispersion in which a molecular or micellar polymer is dispersed, and the like. Any of such a polymer dispersion is preferred for use in the present invention. The particles in the polymer dispersion preferably have a mean particle size falling between 1 and 50,000 nm, more preferably approximately between 5 and 1,000 nm. The particle size distribution of the dispersed particles is not specifically limited. For example, the dispersed particles may have a broad particle size distribution, or may have a monodispersed size distribution.

Preferable examples of polymers which are dispersible in an aqueous solvent for use in the present invention include hydrophobic polymers such as acrylic polymers, poly(esters), rubbers (e.g., SBR resins), poly(urethanes), poly(vinyl chlorides), poly(vinyl acetates), poly(vinylidene chlorides), and poly(olefins). These polymers may be linear, branched or crosslinked. They may be homopolymers from a single monomer, or copolymers from two or more kinds of monomers. The copolymers may be random copolymers or block copolymers.

The polymers preferably have a number-average molecular weight falling between 5,000 and 1,000,000, and more preferably between 10,000 and 200,000. If too small a molecular weight of polymer is used, the mechanical strength of the image-forming layer is insufficient; in contrast, if too large a molecular weight of polymer is used, film forming properties are poor.

3) Latex Binder

Preferred examples of polymer latex for use in the present invention are mentioned below. These polymer latexes are expressed by their constituent monomers, in which each numeral in parentheses indicates the proportion, in terms of % by mass, of the monomer unit, and the molecular weight of the constituent monomers represents the number-average molecular weight. When polyfunctional monomers are used, the molecular weights of the constituent monomers are omitted and only referred to as "crosslinked" in parentheses since the concept of molecular weight does not apply thereto. Tg indicates the glass transition point of a polymer latex.

P-1: Latex of -MMA(70)-EA(27)-MAA(3)-(molecular weight: 37,000; Tg 61° C.)

P-2: Latex of -MMA(70)-2EHA(20)-St(5)-AA(5)-(molecular weight: 40,000; Tg 59° C.)

P-3: Latex of -St(50)-Bu(47)-MMA(3)-(crosslinked; Tg −17° C.)

P-4: Latex of -St(68)-Bu(29)-AA(3)-(crosslinked; Tg 17° C.)

P-5: Latex of -St(71)-Bu(26)-AA(3)-(crosslinked; Tg 24° C.)

P-6: Latex of -St(70)-Bu(27)-IA(3)-(crosslinked)

P-7: Latex of -St(75)-Bu(24)-AA(1)-(crosslinked; Tg 29° C.)

P-8: Latex of -St(60)-Bu(35)-DVB(3)-MAA(2)-(crosslinked)

P-9: Latex of -St(70)-Bu(25)-DVB(2)-AA(3)-(crosslinked)

P-10: Latex of -VC(50)-MMA(20)-EA(20)-AN-(5)-AA(5)-(molecular weight: 80,000)

P-11: Latex of -VDC(85)-MMA(5)-EA(5)-MAA(5)-(molecular weight: 67,000)

P-12: Latex of -Et(90)-MAA(10)- (molecular weight: 12,000)

P-13: Latex of -St(70)-2EHA(27)-AA(3)-(molecular weight: 130,000; Tg 43° C.)

P-14: Latex of -MMA(63)-EA(35)-AA(2)-(molecular weight: 33,000; Tg 47° C.)

P-15: Latex of -St(70.5)-Bu(26.5)-AA(3)-(crosslinked; Tg 23° C.)

P-16: Latex of -St(69.5)-Bu(27.5)-AA(3)-(crosslinked; Tg 20.5° C.)

Abbreviations of constituent monomers are as follows:

MMA: methyl methacrylate
EA: ethyl acrylate
MAA: methacrylic acid
2EHA: 2-ethylhexyl acrylate
St: styrene
Bu: butadiene
AA: acrylic acid
DVB: divinylbenzene
VC: vinyl chloride
AN: acrylonitrile
VDC: vinylidene chloride
Et: ethylene
IA: itaconic acid The polymer latexes mentioned above are commercially available. Some available products employed in the present invention are mentioned below. Examples of acrylic polymers include CEBIAN A-4635, 4718 and 4601 (produced by Daicel Chemical Industries), and NIPOL Lx811, 814, 821, 820 and 857 (produced by Nippon Zeon); examples of poly(esters) include FINETEX ES650, 611, 675 and 850 (produced by Dai-Nippon Ink & Chemicals), and WD-size and WMS (produced by Eastman Chemical); examples of poly(urethanes) include HYDRAN AP10, 20, 30 and 40

(produced by Dai-Nippon Ink & Chemicals); examples of rubbers include LACSTAR 7310K, 3307B, 4700H and 7132C (produced by Dai-Nippon Ink & Chemicals), and Nipol Lx416, 410, 438C and 2507 (produced by Nippon Zeon); examples of poly(vinyl chlorides) include G351 and G576 (produced by Nippon Zeon); examples of poly (vinylidene chlorides) include L502 and L513 (produced by Asahi Kasei); and examples of poly(olefins) include CHEMIPEARL S120 and SA100 (produced by Mitsui Petrochemical).

These polymer latexes may be used either singly or, as necessary, in combination of two or more.

Particularly preferable polymer latex for use in the present invention is styrene/butadiene copolymer latex. In the styrene/butadiene copolymer, the ratio of styrene monomer unit to butadiene monomer unit preferably falls between 40/60 and 95/5 by mass. Further, the proportion of styrene monomer unit and butadiene monomer unit preferably accounts for from 60 to 99% by mass of the copolymer. The preferred range of the molecular weight of the copolymer is the same as described above.

Preferred styrene/butadiene copolymer latexes for use in the present invention are the above-mentioned P-3 to P-8, P-14 and P-15, and commercially available products, LACSTAR-3307B, 7132C, and NIPOL Lx416.

4) Simultaneous Use of Hydrophilic Polymer

The organic silver salt-containing layer of the thermally developable photosensitive material of the present invention may optionally contain a hydrophilic polymer serving as a binder, such as gelatin, polyvinyl alcohol, methyl cellulose, hydroxypropyl cellulose and the like. The amount of the hydrophilic polymer to be included in the layer is preferably at most 30% by mass, and more preferably at most 20% by mass of the total binder in the organic silver salt-containing layer.

5) Coating Amount of Binder

It is preferable to use a polymer latex as the binder for forming the organic silver salt-containing layer (that is, the image-forming layer) of the thermally developable photosensitive material of the present invention. Specifically, the binder is used in the organic silver salt-containing layer in a ratio of a total binder/an organic silver salt falling between 1/10 and 10/1, and more preferably between 1/5 and 4/1 by mass.

The organic silver salt-containing layer is a photosensitive layer (an emulsion layer) which generally contains a photosensitive silver salt, that is, a photosensitive silver halide. In the layer, the ratio of total binder/silver halide preferably falls between 5 and 400, and more preferably between 10 and 200 by mass.

The overall amount of the binder in the image-forming layer of the thermally developable photosensitive material of the present invention preferably falls between 0.2 and 30 $g/m^2$, and more preferably between 1 and 15 $g/m^2$. The image-forming layer may optionally contain a crosslinking agent, and a surfactant for improving the coatability of the coating solution.

6) Solvent for Coating Solution

According to the invention, a solvent (for the purpose of simplicity, both of a solvent and a dispersion medium are together expressed as a solvent) of an organic silver salt-containing layer coating solution for the thermally developable photosensitive material is preferably an aqueous solvent containing 30% by mass or more of water. As for other components than water, an optional water-miscible organic solvent such as methyl alcohol, ethyl alcohol, isopropyl alcohol, Methyl Cellosolve, Ethyl Cellosolve, dimethyl formamide, ethyl acetate or the like may be used. A water content in the solvent is preferably 50% by mass or more and more preferably 70% by mass or more.

Examples of preferable solvent compositions include water=100, water/methyl alcohol=90/10, water/methyl alcohol=70/30, water/methyl alcohol/dimethyl formamide=80/15/5, water/methyl alcohol/Ethyl Cellosolve=85/10/5 and water/methyl alcohol/isopropyl alcohol=85/10/5 (numerical values are shown by "percent by mass").

2-1-7. Fogging Inhibitor

Fogging inhibitors preferably for use in the present invention include the compound represented by the following formula (H):

$$Q\text{-}(Y)n\text{-}C(Z_1)(Z_2)X \quad (H)$$

wherein Q represents an alkyl, aryl or heterocyclic group; Y represents a divalent linking group; n indicates 0 or 1; $Z_1$ and $Z_2$ each represent a halogen atom; and X represents a hydrogen atom or an electron-attracting group.

In formula (H), Q preferably represents an aryl group or a heterocyclic group.

In formula (H), when Q represents a heterocyclic group, a nitrogen-containing heterocyclic group which contains one or two nitrogen atoms is preferable, with a 2-pyridyl group or a 2-quinolyl group being particularly preferable.

In formula (H), when Q represents an aryl group, Q preferably represents a phenyl group substituted by an electron-pulling group in which the Hammet's substituent constant up has a positive value. Regarding the Hammet's substituent constant, *Journal of Medicinal Chemistry*, 1973, Vol. 16, No. 11, pp. 1207 to 1216 can be referred to.

Examples of such electron-pulling groups include a halogen atom (for example, a fluorine atom (σp value: 0.06), a chlorine atom (σp value: 0.23), a bromine atom (σp value: 0.23) or an iodine atom (σp value: 0.18)), a trihalomethyl group (for example, a tribromomethyl group (σp value: 0.29), a trichloromethyl group (σp value: 0.33) or a trifluoromethyl group (σp value: 0.54)), a cyano group (σp value: 0.66), a nitro group (σp value: 0.78), an aliphatic, aryl or a heterocyclic sulfonyl group (for example, a methane sulfonyl group (σp value: 0.72)), an aliphatic, aryl or a heterocyclic acyl group (for example, an acetyl group (σp value: 0.50) or a benzoyl group (σp value: 0.43)), an alkynyl group (for example, C═CH (σp value: 0.23)), an aliphatic, aryl or a heterocyclic oxycarbonyl group (for example, a methoxycarbonyl group (σp value: 0.45) or a phenoxycarbonyl group (σp value; 0.44)), a carbamoyl group (σp value: 0.36), a sulfamoyl group (σp value: 0.57), a sulfoxide group, a heterocyclic group and a phosphoryl group.

A σp value is preferably in a range of from 0.2 to 2.0, and more preferably in a range of from 0.4 to 1.0.

Such electron attracting groups are preferably a carbamoyl group, an alkoxycarbonyl group, an alkylsulfonyl group, an alkylphosphoryl group, a carboxyl group, an alkyl- or arylcarbonyl group and an arylsulfonyl group, more preferably a carbamoyl group, an alkoxycarbonyl group, an alkylsulfonyl group and an alkylphosphoryl group, and most preferably a carbamoyl group.

In formula (H), X preferably represents an electron attracting group and more preferably represents a halogen atom, an aliphatic-, aryl- or a heterocyclic sulfonyl group, an aliphatic-, aryl- or a heterocyclic acyl group, an aliphatic-, aryl- or a heterocyclic oxycarbonyl group, a carbamoyl group or a sulfamoyl group and particularly preferably represents a halogen atom.

Among such halogen atoms, a chlorine atom, a bromine atom and an iodine atom are preferable and, among them, a chlorine atom and a bromine atom are more preferable and, above all, a bromine atom is particularly preferable.

In formula (H), Y preferably represents —C(=O)—, —SO— or —$SO_2$— and more preferably represents —C(=O)—, or —$SO_2$— and particularly preferably represents —$SO_2$—. Further, in formula (H), n represents 0 or 1 and preferably represents 1.

Specific examples of the compounds represented by formula (H) according to the invention are given below and should not be interpreted as limiting the invention.

(H-1)

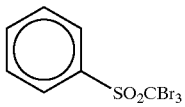

(H-2)

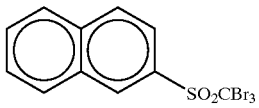

(H-3)

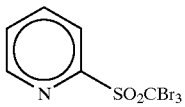

(H-4)

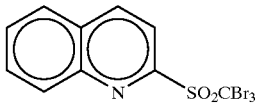

(H-5)

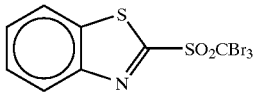

(H-6)

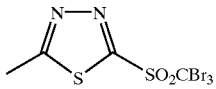

(H-7)

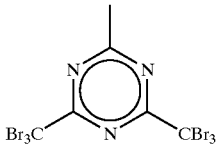

(H-8)

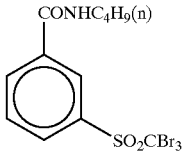

(H-9)

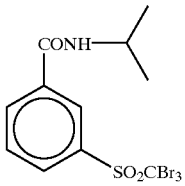

-continued (H-10)

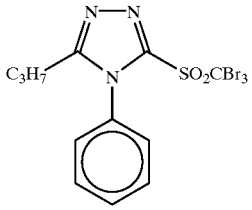

(H-11)

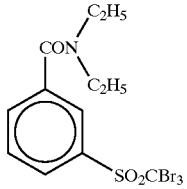

(H-12)

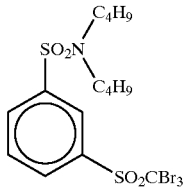

(H-13)

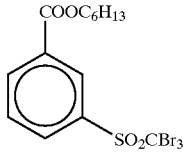

(H-14)

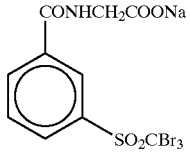

(H-15)

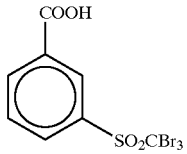

(H-16)

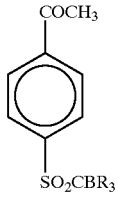

(H-17)

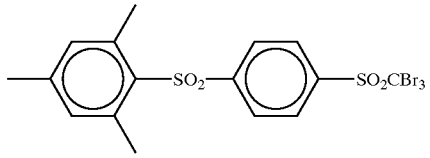

(H-18)

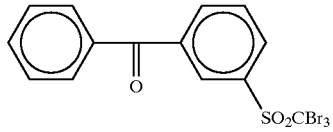

-continued (H-19)

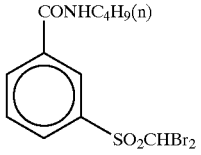

(H-20)

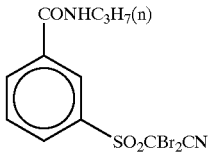

(H-21)

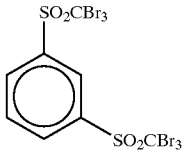

(H-22)

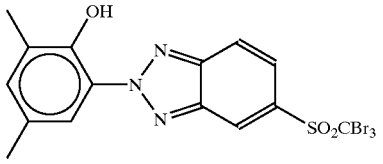

(H-23)

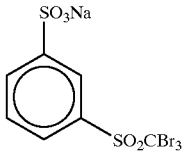

(H-24)

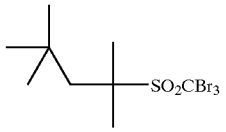

The compound represented by formula (H) is preferably used in a range of from $10^{-4}$ mol to 1 mol, more preferably in a range of from $10^{-3}$ mol to 0.5 mol and still more preferably from $1\times10^{-2}$ mol to 0.2 mol per mol of the non-photosensitive silver salt in the image-forming layer.

According to the invention, as for the method of incorporating the compound represented by formula (H) into the photosensitive material, same methods as in the reducing agent can be applied.

A melting point of the compound represented by formula (H) is preferably 200° C. or less and more preferably 170° C. or less.

As to other organic polyhalogen compounds, mentioned are such compounds as disclosed in patents cited in paragraphs [0111] and [0112] of JP-A No. 11-65021. Particularly, organic halogen compounds represented by formula (P) in Japanese Patent Application No. 11-87297, organic polyhalogen compounds represented by formula (II) in JP-A No. 10-339934 and organic polyhalogen compounds described in Japanese Patent Application No. 11-205330 are preferable.

2-1-8. Other Fogging Inhibitors

Examples of other fogging inhibitors include a mercury (II) salt described in paragraph [0113] of JP-A No. 11-65021; benzoic acids described in paragraph [0114] of JP-A No. 11-65021; a salicylic acid derivative described in JP-A No. 2000-206642; a formalin scavenger compound represented by formula (S) in JP-A No. 2000-221634; a triazine compound related to claim 9 in JP-A No. 11-352624; a compound represented by formula (III) in JP-A No. 6-11791; and 4-hydoxy-6-methyl- 1,3,3a,7-tetrazaindene.

As to fogging inhibitors, stabilizers and stabilizer precursors employable in the invention, those related to patents described in paragraph [0070] of JP-A No. 10-62899 and from line 57, page 20 to line 7, page 21 of EP-A No.0,803,764; and compounds described in JP-A Nos. 9-281637 and 9-329864 are mentioned.

The thermally developable photosensitive material according to the invention may contain an azolium salt for the purpose of inhibiting fog. Examples of such azolium salts include a compound represented by formula (XI) in JP-A No. 59-193447, a compound described in JP-B No. 55-12581 and a compound represented by formula (II) in JP-A No. 60-153039. The azolium salt may be added in any part of the thermally developable photosensitive material; however, as for a layer into which the azolium salt is added, the layer on the side in which a photosensitive layer is present is preferable and the layer containing the organic silver salt is more preferable.

Addition of the azolium salt may be carried out at any time, that is, in any step of preparation of a coating liquid. In a case of adding the azolium salt to the layer containing the organic silver salt, the azolium salt may be added in any step from preparation of the organic silver salt to preparation of a coating liquid; however, the azolium salt is preferably added in a time period between after preparation of the organic silver salt and immediately before coating. As for addition methods of the azolium salt, any method of using powder, a solution or a fine particle dispersion may be adopted. The azolium salt may also be added in a form of a solution mixed with other additives such as a sensitizing dye, a reducing agent and a toning agent.

According to the invention, an amount of the azolium salt to be added may be optional, but is preferably in a range of from $1\times10^{-6}$ mol to 2 mol and more preferably in a range of from $1\times10^{-3}$ mol to 0.5 mol per mol of silver.

2-1-9. Other Additives

1) Mercapto, Disulfide and Thione Compounds

According to the invention, for the purposes of controlling development through suppressing or accelerating development, improving spectral sensitization efficiency and improving storability after and before development, at least one member selected from the group consisting of mercapto compounds, disulfide compounds and thione compounds can be incorporated. Examples of such compounds include compounds described in paragraphs [0067] to [0069] of JP-A No. 10-62899, compounds represented by formula (I) and, as specific examples thereof, described in paragraphs [0033] to [0052] in JP-A No. 10-186572 and compounds described in lines 36 to 56, page 20 of EP-A No. 0,803,764. Among them, mercapto-substituted heteroaromatic compounds described in JP-A Nos. 9-297367, 9-304875 and 2001-100358, and Japanese Patent Application Nos. 2001-104213 and 2001-104214 are preferable.

2) Toning Agent

In the thermally developable photosensitive material according to the invention, a toning agent is preferably added. Examples of such toning agents include those described in paragraphs [0054] to [0055] of JP-A No. 10-62899, lines 23 to 48, page 21 of EP-A No. 0,803,764, JP-A No. 2000-356317 and Japanese Patent Application No. 2000-187298. In particular, phthalazinones (phthalazinone, phthalazinone derivatives or metal salts thereof; for example, 4-(1-naphthyl) phthalazinone, 6-chlorophthalazinone, 5,7-dimethoxy phthalazinone and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate and tetrachlorophthalic acid anhydride); and phthalazines (phthalazine, phthalazine derivatives or metal salts thereof; for example, 4-(1-naphthyl)phthalazine, 6-isopropylphthalazine, 6-t-butylphthalazine, 6-chlorophthalazine, 5,7-dimethoxyphthalazine and 2,3-dihydrophthalazine) are preferable. In a case of a combination with a silver halide having a composition of a high silver iodide content ratio, combinations of phthalazines and phthalic acids are particularly preferable.

An amount of phthalazines to be added is in a range of from 0.01 mol to 0.3 mol, more preferably in a range of from 0.02 mol to 0.2 mol and particularly preferably in a range of from 0.02 mol to 0.1 mol per mol of the organic silver salt.

3) Plasticizer and Lubricant

Plasticizers and lubricants employable in the photosensitive layer in the material according to the invention are described in paragraph [0117] of JP-A No. 11-65021. Lubricants are described in paragraphs [0061] to [0064] of JP-A No. 11-84573 and paragraphs [0049] to [0062] of Japanese Patent Application No. 11-106881.

4) Dye and Pigment

In the photosensitive layer in the material according to the invention, from the viewpoint of improvement of color tone, prevention of interference fringe pattern caused by an exposure with laser light and prevention of irradiation, various types of dyes and pigments (for example, C. I. Pigment Blue 60, C. I. Pigment Blue 64, and C. I. Pigment Blue 15:6) can be used. Concerning these matters, detailed descriptions are found in WO98/36322, JP-A Nos. 10-268465 and 11-338098 and the like.

5) Ultrahard Gradation Enhancing Agent

For the purpose of forming an ultrahigh gradation image appropriate for a printing plate-making application, an ultrahard gradation enhancing agent is preferably added to the image-forming layer. As to such ultrahard gradation enhancing agents, addition methods thereof and addition quantities thereof, compounds described in paragraph [0118] of JP-A No. 11-65021 and paragraphs [0136] to [0193] of JP-A No. 11-223898, compounds represented by formula (H), formulas (1) to (3) and formulas (A) and (B) in Japanese Patent Application No. 11-87297, compounds (illustrative compounds being represented by chemical formulas 21 to 24) represented by formulas (III) to (V) described in Japanese Patent Application No. 11-91652 and high gradation accelerators described in paragraph [0102] of JP-A No. 11-65021 and paragraphs [0194] and [0195] of JP-A No. 11-223898.

When formic acid or a salt thereof is used as a strong fogging substance, the fogging substance is preferably contained on the side having the image-forming layer containing the photosensitive silver halide in an amount of 5 milimol or less and preferably in an amount of 1 milimol or less per mol of silver.

When the ultrahard gradation enhancing agent is used in the thermally developable photosensitive material according to the invention, it is preferable to simultaneously use an acid or a salt thereof formed by hydration of phosphorus pentoxide. Examples of such acids formed by hydration of phosphorus pentoxide or salts thereof include metaphosphoric acid (salt), pyrophosphoric acid (salt), orthophosphoric acid (salt), triphosphoric acid (salt), tetraphosphoric acid (salt) and hexametaphosphoric acid (salt). Particularly preferable acids formed by hydration of phosphorus pentoxide or salts thereof are orthophosphoric acid (salt) and hexametaphosphoric acid (salt). Specific examples of the salts thereof include sodium orthophosphate, sodium dihydrogen orthophosphate, sodium hexametaphosphate and ammonium hexametaphosphate.

An amount to be used of the acid formed by hydration of phosphorus pentoxide or the salt thereof (a coated amount per $m^2$ of the thermally developable photosensitive material) may be a desired amount in accordance with properties such as sensitivity and fog, but is preferably in a range of from 0.1 $mg/m^2$ to 500 $mg/m^2$ and more preferably in a range of from 0.5 $mg/m^2$ to 100 $mg/m^2$.

2—2. Layer Construction

The image-forming layer according to the invention may be constructed by a monolayer or a multilayer. In a case of a monolayer, the image-forming layer contains a non-photosensitive organic silver salt, a photosensitive silver halide, a reducing agent and the binder, and, optionally, further contains additional materials such as a toning agent, a covering aid and other auxiliary agents. In a case of a multilayer, a first image-forming layer (ordinarily a layer adjacent to a support) contains the organic silver salt and the silver halide, and a second image-forming layer or both layers must contain some of such other components. In a constitution of a multi-color thermally developable photosensitive material, each color may comprise a combination of these two layers or all the components may be contained in one layer as described in U.S. Pat. No. 4,708,928. In a case of the multi-color thermally developable photosensitive material, each emulsion layer is ordinarily maintained in a separated manner by providing a functional or non-functional barrier layer between any two photosensitive layers as described in U.S. Pat. No. 4,460,681.

The thermally developable photosensitive material according to the invention may have a non-photosensitive layer in addition to the image-forming layer. The non-photosensitive layer can be devided according to its position as follows; (a) a surface protective layer provided on the image-forming layer (on the farther side from the support); (b) an intermediate layer formed between any two of a plurality of image-forming layers or between the image-forming layer and the protective layer; (c) an undercoat layer provided between the image-forming layer and the support; and (d) a back layer provided on the opposite side of the image-forming layer.

A layer which acts as an optical filter can be provided as a layer classified in the above-described (a) or (b). An antihalation layer can be provided in the thermally developable photosensitive material as a layer classified as the above-described (c) or (d).

1) Surface Protective Layer

In the thermally developable photosensitive material according to the invention, a surface protective layer can be provided for the purpose of preventing adhesion of the image-forming layer and the like. The surface protective layer may be made up of a single layer or a plurality of layers. Such surface protective layers are described in paragraphs [0119] to [0120] of JP-A No. 11-65021 and Japanese Patent Application No. 2000-171936.

As to the binder contained in the surface protective layer in the material according to the invention, gelatin is preferably used, but polyvinyl alcohol (PVA) is also preferably used either alone or in combination with gelatin. As to gelatin, inert gelatin (for example, Nitta Gelatin 750; available from Nitta Gelatin Inc.), phthalated gelatin (for example, Nitta Gelatin 801; available from Nitta Gelatin Inc.) and the like can be used.

As the PVA, such PVA's described in paragraphs [0009] to [0020] of JP-A No. 2000-171936 are mentioned; specifically, PVA-105 as a completely saponified substance, PVA-205, or PVA-335 as a partially saponified substance, and MP-203 as a modified polyvinyl alcohol (these are trade names and available from Kuraray Co., Ltd.) are preferably mentioned.

A coating amount (per $m^2$ of the support) of polyvinyl alcohol of the protective layer (per layer) is preferably in a range of from 0.3 $g/m^2$ to 4.0 $g/m^2$ and more preferably in a range of from 0.3 $g/m^2$ to 2.0 $g/m^2$.

A coating amount (per $m^2$ of the support) of the entire binder (inclusive of water-soluble polymer and latex polymer) of the surface protective layer (per layer) is preferably in a range of from 0.3 $g/m^2$ to 5.0 $g/m^2$ and more preferably in a range of from 0.3 $g/m^2$ to 2.0 $g/m^2$.

2) Antihalation Layer

In the thermally developable photosensitive material according to the invention, the antihalation layer can be provided on a side far from an exposure light source relative to the photosensitive layer. As to such antihalation layers, descriptions are found in paragraphs [0123] and [0124] of JP-A No. 11-65021, JP-A Nos. 11-223898, 9-230531, 10-36695, 10-104779, 11-231457, 11-352625, 11-352626 and the like.

The antihalation layer contains an anti-halation dye having absorption in an exposure light wavelength. In a case in which the exposure light wavelength is in an infrared region, an infrared ray-absorbing dye may be used whereupon a dye having no absorption in a visible wavelength region is preferable.

When antihalation is performed using a dye having absorption in the visible wavelength region, it is preferable that color of the dye does not substantially remain after an image is formed. Any methods for dye to be decolorized by heat in thermal development are preferably used. It is particularly preferable that a heat-decolorizable dye and a basic precursor are added in the non-photosensitive layer to allow the layer to function as the anti-halation layer. These techniques are described in JP-A No. 11-231457 and the like.

An addition amount of the decolorizable dye is determined in accordance with an applicability of the dye. Ordinarily, the decolorizable dye is used in such an amount that an optical density (absorbance) measured at a target wavelength exceeds 0.1. The optical density is preferably in a range of from 0.2 to 2. The amount of the decolorizable dye to be used for obtaining such a level of the optical density is ordinarily in a range of approximately from 0.001 $g/m^2$ to 1 $g/m^2$.

When the dye is decolorized in such a manner, the optical density after thermal development can be lowered to 0.1 or less. Two or more types of decolorizable dyes may be used in combination in a heat-decolorizable type recording material or in the thermally developable photosensitive material. In a similar manner, two or more types of basic precursors may be used in combination.

In heat decolorization using such a decolorizable dye and basic precursor, from the viewpoint of the heat decolorization property and the like, it is preferable to simultaneously use a substance (e.g., diphenylsulfone or 4-chlorophenyl (phenyl) sulfone) which decreases a melting point by 3° C. or more when mixed with such basic precursor as described in JP-A No. 11-352626.

3) Back layer

As to a back layer which is applicable to the invention, descriptions are found in paragraphs [0128] to [0130] of JP-A No. 11-65021.

According to the invention, a coloring agent having an absorption maximum in a wavelength region of from 300 nm to 450 nm can be added for the purposes of improving a silver color tone and improving an image change with time. Such coloring agents are described in JP-A Nos. 62-210458, 63-104046, 63-103235, 63-208846, 63-306436, 63-314535, 1-61745, Japanese Patent Application No. 11-276751, etc. These coloring agents are ordinarily added in an amount in a range of from 0.1 $mg/m^2$ to 1 $g/m^2$. As to a layer to be added, the back layer provided on an opposite side of the photosensitive layer is preferable.

4) Matting Agent

According to the invention, it is preferable to add a matting agent to the surface protective layer and the back layer for the purpose of improving a transportation property. Such matting agents are described in paragraphs [0126] and [0127] of JP-A No. 11-65021.

A coating amount of the matting agent is preferably in a range of from 1 $mg/m^2$ to 400 $mg/m^2$ and more preferably from 5 $mg/m^2$ to 300 $mg/m^2$ per $m^2$ of the thermally developable photosensitive material.

A matting degree of an emulsion surface is not particularly limited so far as a so-called star dust-like defect, in which a small blank area is generated in an image part to cause light leaks, does not occur. However, a Beck's degree of smoothness is preferably in a range of from 30 seconds to 2000 seconds and particularly preferably in a range of from 40 seconds to 1500 seconds. The Beck's degree of smoothness can easily be obtained according to "Testing Method for Smoothness of Paper and Paperboard with Beck's Tester", the Japanese Industrial Standards (JIS) P8119 and the TAPPI Standard Method T479.

According to the invention, the Beck's degree of smoothness as a matting degree for the back layer is preferably in a range of from 10 seconds to 1200 seconds, more preferably from 20 seconds to 800 seconds, and still more preferably from 40 seconds to 500 seconds.

According to the invention, the matting agent is preferably contained in an outermost surface layer, a layer which functions as the outermost surface layer of the thermally developable photosensitive material, a layer in a neighborhood of an outer surface layer or a layer which functions as the so-called protective layer.

5) Polymer Latex

A polymer latex can be added to the surface protective layer and the back layer.

Such polymer latexes are described in "Synthetic Resin Emulsion", compiled by Taira Okuda and Hiroshi Inagaki, Kobunshi Kankokai (Polymer Publishing), 1978, "Application of Synthesized Latex", compiled by Takaaki Sugimura, Yasuo Kataoka, Soichi Suzuki and Keiji Kasahara, Kobunshi Kankokai (Polymer Publishing), 1993, Soichi Muroi, "Chemistry of Synthesized Latex", Kobunshi Kankokai (Polymer Publishing), 1970 and the like. Specific examples of the polymer latexes include a latex of a methyl methacrylate (33.5% by mass)/ethyl acrylate (50% by mass)/methacrylic acid (16.5% by mass) copolymer, a latex of a methyl methacrylate (47.5% by mass)/butadiene (47.5% by mass)/itaconic acid (5% by mass) copolymer, a latex of an ethyl acrylate/methacrylic acid copolymer, a latex of a methyl methacrylate (58.9% by mass)/2-ethylhexyl acrylate (25.4% by mass)/styrene (8.6% by mass)/2-hydroxyethyl metacrylate (5.1% by mass)/acrylic acid (2.0% by mass)

copolymer, and a latex of a methyl methacrylate (64.0% by mass)/styrene (9.0% by mass)/butylacrylate (20.0% by mass)/2-hydroxyethyl metacrylate (5.0% by mass)/acrylic acid (2.0% by mass) copolymer.

The polymer latex is used in an amount, based on the entire binder in the surface protective layer or the back layer, of preferably from 10% by mass to 90% by mass and particularly preferably from 20% by mass to 80% by mass.

6) Film Surface pH

In the thermally developable photosensitive material according to the invention, a pH of a film surface before thermal development is preferably 7.0 or less and more preferably 6.6 or less. A lower limit thereof is not particularly limited, but is approximately 3. A most preferable pH range is from 4 to 6.2.

For adjusting the pH of the film surface, it is preferable from the viewpoint of lowering the pH of the film surface to use an organic acid such as a phthalic acid derivative, a non-volatile acid such as sulfuric acid or a volatile base such as ammonia. Particularly, ammonia is preferable in achieving a low pH of the film surface, because ammonia is particularly apt to be vaporized and can be removed during a coating process or before a thermal development process.

It is also preferable that a non-volatile base such as sodium hydroxide, potassium hydroxide or lithium hydroxide is used with ammonia in combination. Further, measurement methods of the pH of the film surface are described in paragraph [0123] of Japanese Patent Application No. 11-87297.

7) Film-Hardening Agent

A film-hardening agent may be used in each of the photosensitive layer, the protective layer, the back layer and the like according to the invention.

Examples of such film-hardening agents are found in various methods described in T. H. James, "*The Theory of the Photographic Process*", 4th edition, pp.77 to 87, Macmillan Publishing Co., Inc., 1977. Other preferable examples of the film-hardening agents include not only chrome alum, a sodium salt of 2,4-dichloro-6-hydroxy-s-triazine, N,N-ethylene bis(vinylsulfonacetamide) and N,N-propylene bis(vinylsulfonacetamide), but also multi-valent metal ions described in the above-cited reference, pp. 78, polyisocyanates described in U.S. Pat. No. 4,281,060 and JP-A No. 6-208193, epoxy compounds described in U.S. Pat. No. 4,791,042 and vinyl sulfone type compounds described in JP-A No. 62-89048.

The film-hardening agent is added in a state of a solution. Timing of adding such film-hardening agent solution in the protective layer coating liquid is in a time period of from 180 minutes before a coating operation to immediately before the coating operation, and preferably from 60 minutes before a coating operation to 10 seconds before the coating operation whereupon mixing methods and mixing conditions of the film-hardening agent solution are not particularly limited so far as the effects of the invention are sufficiently revealed.

Specific examples of the mixing methods include a mixing method using a tank in which an average staying time calculated from an addition flow rate and a feeding flow rate to a coater is allowed to be a desired time and a mixing method using a static mixer or the like described in N. Harnby, M. F. Edwards and A. W. Nienow, "*Techniques of Mixing Liquids*", translated by Koji Takahashi, Chapter 8, Nikkan Kogyo Newspaper, 1989.

8) Surfactant

Surfactants to be applicable to the invention are described in paragraph [0132] of JP-A No. 11-65021.

According to the invention, it is preferable to use a fluorine type surfactant. As specific examples of such surfactants, mentioned are compounds described in JP-A Nos. 10-197985, 2000-19680, 2000-214554 and the like. A polymeric fluorine type surfactant described in JP-A No. 9-281636 is also preferably used. In the thermally developable photosensitive material according to the invention, fluorine type surfactants described in Japanese Patent Application Nos. 2000-206560, 2001-203462, 2001-242357 and 2001-264110 are preferably used. Particularly, fluorine type surfactants described in Japanese Patent Application Nos. 2001-242357 and 2001-264110 are in a state of an aqueous coating liquid and are preferable from the standpoint of electrostatic property adjusting ability, stability of a state of a coated surface and slipping ability when coating-preparation is performed. Above all, the fluorine type surfactants described in Japanese Patent Application No. 2001-264110 are most preferable due to a high electrostatic property adjusting ability and a small amount of use.

According to the invention, the fluorine type surfactant can be used on any of the emulsion surface and the back surface and is preferably used in both surfaces. Further, the fluorine type surfactant is particularly preferably used in combination with an electric conductive layer containing the above-described metal oxide. In this case, even when an amount of the fluorine type surfactant to be used in a surface having the electric conductive layer is decreased or eliminated, a sufficient performance can be obtained.

A use amount of the fluorine type surfactant on each of the emulsion surface and the back surface is preferably in a range of from 0.1 $mg/m^2$ to 100 $mg/m^2$, more preferably in a range of from 0.3 $mg/m^2$ to 30 $mg/m^2$, still more preferably in a range of from 1 $mg/m^2$ to 10 $mg/m^2$. Particularly, the fluorine type surfactant described in Japanese Patent Application No. 2001-264110 is effective to a great extent and is used preferably in a range of from 0.01 $mg/m^2$ to 10 $mg/m^2$ and more preferably in a range of from 0.1 $mg/m^2$ to 5 $mg/m^2$.

9) Anti-Static Agent

In the invention, an anti-static layer comprising any one of electrically conductive materials such as various types of known metal oxides and electric conductive polymers may be contained. As for the electrically conductive materials, metal oxides in which electric conductivity has been enhanced by incorporating an oxygen defect or a heteroatom into such metal oxide are preferably used. As examples of the metal oxides, ZnO, $TiO_2$ and $SnO_2$ are preferable. At least one of Al and In are preferably added to ZnO and, in a same manner, at least one of Sb, Nb, P, a halogen atom and the like to $SnO_2$, and at least one of Nb, Ta and the like to $TiO_2$. Particularly, $SnO_2$ added with Sb is preferable. An amount of the heteroatom to be added is preferably in a range of from 0.01 mol % to 30 mol % and more preferably in a range of from 0.1 mol % to 10 mol %. A shape of the metal oxide may be any of a spherical shape, an acicular shape and a tabular shape, and from the point of imparting conductivity, a grain in an acicular shape having a ratio of long to short axes of 2.0 or more and, preferably, from 3.0 to 50 is preferable. An amount of the metal oxide to be used is preferably in a range of from 1 $mg/m^2$ to 1000 $mg/m^2$, more preferably in a range of from 10 $mg/m^2$ to 500 $mg/m^2$ and still more preferably in a range of from 20 $mg/m^2$ to 200 $mg/m^2$.

The anti-static layer may be provided on any of an image-forming layer side and a back layer side, so that the anti-static layer may simultaneously functions as the above-described undercoat layer, back layer, protective layer or the like or may be provided separately from these layers. Preferably, the anti-static layer is provided between the support and the back layer. As for the anti-static layer, techniques described in paragraph [0135] of JP-A No. 11-65021, JP-A Nos. 56-143430, 56-143431, 58-62646 and 56-120519, paragraphs [0040] to [0051] of JP-A No. 11-84573, U.S. Pat. No. 5,575,957, paragraphs [0078] to [0084] of JP-A No. 11-223898, JP-A Nos. 7-295146 and 11-223901 are employable.

10) Support

As a transparent support, a polyester, in particular, polyethylene terephthalate, which has thermally been treated in a temperature range of from 130° C. to 185° C. in order to relax residual internal stress in a film at the time of biaxially stretching and to eliminate stress of thermal contraction generated in thermal development is preferably used.

In a case of the thermally developable photosensitive material for medical use, the transparent support may be colored with blue dyes (for example, Dye-1 described in JP-A No. 8-240877) or may remain colorless. Specific examples of such supports are described in paragraph [0134] of JP-A No. 11-65021.

To the support, undercoating techniques using a water-soluble polyester described in JP-A No. 11-84574, a styrene/butadiene copolymer described in JP-A No. 10-186565, vinylidene chloride copolymers described in JP-A No. 2000-39684 and paragraphs [0063] to [0080] of Japanese Patent Application No. 11-106881 and the like are preferably adopted.

It is preferable that the thermally developable photosensitive material according to the invention is a mono-sheet type (a type capable of forming an image on a sheet of the thermally developable photosensitive material-without using a separate sheet such as an image-receiving material).

11) Other Additives

To the thermally developable photosensitive material, an anti-oxidant, a stabilizing agent, a plasticizer, a UV absorbent or a covering aid may further be added. A solvent described in paragraph [0133] of JP-A No. 11-65021 may also be added thereto. These various additives are added to either the photosensitive layer or the non-photosensitive layer. Concerning these matters, WO98/36322, EP-A No. 803764, JP-A Nos. 10-186567, 10-18568 and the like can be referred to.

12) Preparation and Viscosity Characteristics of Coating Solution

A preparation temperature of the image-forming layer coating solution employed in the invention is preferably in a range of from 30° C. to 65° C., more preferably from 35° C. to less than 60° C. and still more preferably from 35° C. to 55° C. Further, it is preferable that a temperature of the image-forming layer coating liquid immediately after adding the polymer latex is maintained in a range of from 30° C. to 65° C.

The organic silver salt-containing layer coating liquid according to the invention is preferably a so-called thixotropic fluid. As to techniques of such thixotropic fluids, JP-A No. 11-52509 can be referred to. In the present invention, viscosity of the organic silver salt-containing layer coating liquid under a shearing velocity of 0.1 $S^{-}$is preferably in a range of from 400 mPa.s to 100,000 mPa.s and more preferably in a range of from 500 mPa.s to 20,000 mPa.s.

Such a viscosity under a shearing velocity of 1,000 $S^{-1}$ is preferably in a range of from 1 mPa.s to 200 mPa.s and more preferably in a range of from 5 mPa.s to 80 mPa.s.

13) Coating Method

The thermally developable photosensitive material according to the invention may be coated by any method. Specifically, various types of coating methods including extrusion coating, slide coating, curtain coating, dip coating, knife coating, flow coating, and extrusion coating using a type of hopper described in U.S. Pat. No. 2,681,294 are used. Extrusion coating described in Stephen F. Kistler and Peter M. Schweizer, "*Liquid Film Coating*", pp. 399 to 536, Chapman & Hall, 1997 or slide coating is preferably used. In particular, the slide coating is preferably used.

Examples of shapes of slide coaters used for the slide coating are described in the above-cited book, page 427, FIG. 11b-1. As desired, two or more layers can simultaneously be coated by methods described in the above-cited book, pp. 399 to 536, U.S. Pat. No. 2,761,791 and British Patent No. 837,095.

14) Packaging Material

It is preferable that the thermally developable photosensitive material according to the invention is seal-packed by a packaging material imparted with at least one property of low oxygen permeability and/or low moisture permeability, in order to prevent a photographic property thereof from being deteriorated during a storage period before being put in actual use or, in a case in which an end-product is in a roll state, to prevent the thermally developable photosensitive material from being curled or being imparted with a winding crimp. The oxygen permeability at 25° C. is preferably less than 50 ml/atm/$m^2$·day, more preferably less than 10 ml/atm/$m^2$·day and still more preferably less than 1.0 ml/atm/$m^2$·day. The moisture permeability is preferably less than 10 g/atm/$m^2$·day, more preferably less than 5 g/atm/$m^2$·day and still more preferably less than 1 g/atm/$m^2$·day. As specific examples of such packaging materials imparted with at least one property of low oxygen permeability and/or low moisture permeability, those described in JP-A Nos. 8-254793 and 2000-206653 are employable.

14) Other Usable Techniques

As to techniques usable in the thermally developable photosensitive material according to the invention, such techniques as described in the following references are further cited: EP-A Nos. 803764 and 883022, W098/36322, JP-A Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565 and 10-186567, from JP-A No. 10-186569 to JP-A No. 10-186572, JP-A Nos. 10-197974, 10-197982 and 10-197983, from JP-A No. 10-197985 to JP-A No. 10-197987, JP-A Nos. 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880 and 11-129629, from JP-A No. 11-133536 to JP-A No. 11-133539, JP-A Nos. 11-133542, 11-133543, 11-223898, 11-352627, 11-305377, 11-305378, 11-305384, 11-305380, 11-316435, 11-327076, 11-338096, 11-338098, 11-338099 and 11-343420, Japanese Patent Application Nos. 2000-187298, 2000-10229, 2000-47345, 2000-206642, 2000-98530, 2000-98531, 2000-112059, 2000-112060, 2000-112104, 2000-112064 and 2000-171936.

3. Image-Forming Method 3-1. Exposure

The thermally developable photosensitive material according to the present invention can be exposed in any manner. Preferably laser light is used as a light source. The laser light for use in the present invention is, for example, gas laser ($Ar^+$, He—Ne or He—Cd), YAG laser, dye laser, or semiconductor laser. Also employable is a combination of a semiconductor laser and a secondary harmonic generating element. Laser to be preferably used is selected corresponding to a light absorption peak wavelength of, for example, a spectral sensitizing dye in the thermally developable photosensitive material, but preferably is the He—Ne laser or a red color semiconductor laser which emits red to infrared light, or the $Ar^+$ laser, the He—Ne laser, the He—Cd laser or a blue color semiconductor laser which emits blue to green light.

Laser light which oscillates in a longitudinal multi-mode by a method such as high frequency superimposition is also favorably used.

3-2. Thermal Development

The thermally developable photosensitive material according to the invention may be developed by any method. Ordinarily, a temperature of the thermally developable photosensitive material which has been exposed image-wise is elevated to allow it to be developed. A development temperature is preferably in a range of from 80° C. to 250° C. and the more preferably in a range of from 100° C. to 140° C. The development time period is preferably from 1 second to 60 seconds, more preferably from 5 seconds to 30 seconds, and still more preferably from 5 seconds to 20 seconds.

As to a thermal development system, a plate heater system is preferably used. As to the thermal development system utilizing the plate heater system, methods described in JP-A No. 11-133572 are preferable, in which there is provided a thermal development apparatus that obtains a visible image by allowing a thermally developable photosensitive material in which a latent image has been formed to contact with a heating unit in a thermal development part thereof wherein the thermal development apparatus is characterized in that the heating unit comprises a plate heater, a plurality of pressure rolls are provided along one surface of the plate heater such that the pressure rolls face to the plate heater and the thermal development is performed by allowing the thermally developable photosensitive material to pass through between the pressure rolls and the plate heater. It is preferable that the plate heater is divided into 2 to 6 steps and that the top step has a temperature lowered by approximately 1° C. to 10° C. For example, a manner in which the temperature for "four sets of plate heaters" controlled to be 112° C., 119° C., 121° C. and 120° C., respectively, is employed.

Such methods as described above are also described in JP-A No. 54-30032; according to these methods, moisture and an organic solvent contained in the thermally developable photosensitive material can be removed out of a system and, also, deformation of the support of the thermally developable photosensitive material caused by rapid heating can be suppressed.

3-3. System

As a laser imager equipped with a light exposure part and a thermal development part for the medical use, Fuji Medical Dry Imager FM-DPL is mentioned. The system is detailed in Fuji Medical Review No. 8, pp. 39 to 55 and the techniques set forth therein are applicable. Further, the thermally developable photosensitive material according to the invention can also be applied as a thermally developable photosensitive material for the laser imager in "AD network", proposed by Fujifilm Medical Co., Ltd., a network system which meets the DICOM Standards.

4. Application of the Invention

The thermally developable photosensitive material of the present invention forms a monochromatic silver image, and hence is preferably used in medical diagnosis, industrial photography, printing and COM (computer output microfilm).

EXAMPLES

The invention will now be illustrated by the following Examples, but it is to be understood that the invention is not limited to the Examples.

Example 1

1. Preparation of PET Support, and Undercoat

1) Film Formation

From terephthalic acid and ethylene glycol, PET was produced in an ordinary manner. PET thus produced had an intrinsic viscosity, IV, of 0.66, as measured in a phenol/tetrachloroethane ratio (6/4 by weight) at 25° C. After pelletized, the PET was dried at 130° C. for 4 hours, and melted at 300° C., followed by extrusion through a T-die. After rapid cooling, a non-oriented film was obtained which had a thickness of 175 μm after thermal fixation.

The resultant film was stretched 3.3 times in MD (machine direction) using a roll at different rotating speeds, then stretched 4.5 times in CD (cross direction) using a tenter. The temperatures for MD and CD stretchings were 110° C. and 130° C., respectively. Then, the film was thermally fixed at 240° C. for 20 seconds, and relaxed by 4% in CD at the same temperature. Subsequently, the chuck of the tenter was released, the both edges of the film was knurled, and the film was rolled up under 4 kg/cm$^2$ to give a rolled film having a thickness of 175 μm.

2) Corona Discharge Surface Treatment

Both surfaces of the support were subjected to corona discharge treatment at room temperature at a speed of 20 m/min, using a solid-state corona discharge system MODEL 6KVA manufactured by Pillar Technologies. From the data of the current and the voltage read from the system, the support was found to be processed at 0.375 kV·A·min/m$^2$. The frequency for the treatment was 9.6 kHz, and the gap clearance between an electrode and a dielectric roll was 1.6 mm.

3) Undercoat 3-1) Preparation of a Coating Solution for an Undercoat Layer:

Formulation (1) (for an undercoat layer at the side of providing an image-forming layer):

| | |
|---|---|
| Pesuresin A-520 (a 30% by mass solution) manufactured by Takamatsu Yushi KK | 59 g |
| Polyethylene glycol monononylphenyl ether (average ethylene oxide number = 8.5, a 10% by mass solution) | 5.4 g |
| Polymer microparticles (MP-1000, mean particle size: 0.4 μm) manufactured by Soken Chemical & Engineering Co., Ltd. | 0.91 g |
| Distilled water | 935 ml |
| Formulation (2) (for a first back layer): | |
| Styrene-butadiene copolymer latex (solid content: 40% by mass, styrene/butadiene ratio = 68/32 by mass) | 158 g |
| Sodium 2,4-Dichloro-6-hydroxy-S-triazine (a 8% by mass aqueous solution) | 20 g |
| Sodium laurylbenzenesulfonate (a 1% by mass aqueous solution) | 10 ml |
| Distilled water | 854 ml |
| Formulation (3) (for a second back layer): | |
| $SnO_2$/SbO (9/1 by mass, mean particle size: 0.038 μm, a 17% by mass dispersion) | 84 g |
| Gelatin (a 10% aqueous solution) | 89.2 g |
| Metolose TC-5 (a 2% aqueous solution) manufactured by Shin-etsu Chemical Industry Co., Ltd. | 8.6 g |
| MP-1000 manufactured by Soken Chemical & Engineering Co., Ltd. | 0.01 g |
| Sodium dodecylbenzenesulfonate (a 1% by mass aqueous solution) | 10 ml |

-continued

| | |
|---|---|
| NaOH (1% by mass) | 6 ml |
| Proxel (manufactured by ICI) | 1 ml |
| Distilled water | 805 ml |

3-2) Undercoat

Both surfaces of the biaxially-oriented polyethylene terephthalate support (thickness: 175 μm) were subjected to corona discharge treatment in the same manner as above. One surface (to have an image-forming layer thereon) of the support was coated with a coating solution of the undercoat layer formulation (1) using a wire bar, and then dried at 180° C. for 5 minutes to provide a wet coated amount of 6.6 ml/m$^2$ (one surface). Next, the other surface (back surface) of the support was coated with a coating solution of the back layer formulation (2) using a wire bar, and then dried at 180° C. for 5 minutes to provide a wet coated amount of 5.7 ml/m$^2$. The thus-coated back surface was further coated with the back layer formulation (3) using a wire bar, and then dried at 180° C. for 6 minutes to provide a wet coated amount of 7.7 ml/m$^2$, to finally give an undercoated support.

2. Back Layer 2-1. Preparation of Coating solution for Back Layer

1) Preparation of Solid Microparticle Dispersion (a) of Basic Precursor 1.5 kg of a basic precursor compound 1, 225 g of "DEMOL-N" (trade name; available from Kao Corporation), 937.5 g of diphenylsulfone and 15 g of parahydroxy benzoic acid methyl ester (trade name: MEK-KINSU M; available from Ueno Pharmaceutical Co., Ltd.) were mixed and, further, made up to be 5.0 kg in a total weight by being added with distilled water and, then, the resultant mixture was dispersed using a lateral sand mill (trade name: UVM-2; available from Aimex, Ltd.). As to a dispersion condition, the mixture was fed to the UVM-2 filled with zirconia beads having an average diameter of 0.5 mm using a diaphragm pump and kept to be dispersed under an inner pressure of 50 hPa or more until a desired degree of dispersion was obtained. Such dispersion processing has been performed until a degree of dispersion became 2.2 in terms of a ratio (D450/D650) of absorbance at 450 nm against that at 650 nm derived from spectral absorption measurements on the dispersed liquid. The thus-obtained dispersion was diluted with distilled water such that a concentration of the basic precursor was 20 wt %, filtered using a filter (average pore diameter: 3 μm; material: polypropylene) to remove dust.

2) Preparation of Dye Solid Microparticle Dispersion (a)

6.0 kg of a cyanine dye compound-1, 3.0 kg of sodium p-dodecylbenzene sulfonate, 0.6 kg of "DEMOL SMB" (trade name; available from Kao Corporation) and 0.15 kg of "Surfynol 104E" (trade name; available from Nissin Chemical Industry Co., Ltd.) were mixed and, then, made up to be 60 kg in a total weight by being added with distilled water. The resultant mixture was dispersed by a lateral sand mill (trade name: UVM-2; available from Aimex, Limited) with zirconia beads having an average diameter of 0.5 mm. Such dispersion processing has been performed until a ratio (D650/D750) of absorbance became 5.0 or more. The thus-obtained dispersion was diluted with distilled water such that a concentration of the cyanine dye was 6 wt %, filtered using a filter (average pore diamete: 1 μm; material: polypropylene) to remove dust.

3) Preparation of Coating Solution for Antihalation Layer 30 g of gelatin, 24.5 g of polyacrylamide, 2.2 g of 1 mol/L caustic soda, 2.4 g of monodisperse polymethyl methacrylate microparticles (average grain size: 8 μm; grain diameter standard deviation: 0.4), 0.08 g of benzoisothiazolinone, 35.9 g of the above-described dye solid microparticle dispersion (a), 74.2 g of the above-described solid microparticle dispersion (a) of the basic precursor, 0.6 g of sodium polyethylenesulfonate, 0.21 g of a blue dye compound-1, 0.15 g of a yellow dye compound-1 and 8.3 g of acrylic acid/ethyl acrylate copolymerization latex (copolymerization ratio: 5/95) were mixed and made up to be 818 mL in a total volume by being added with water, thereby preparing a coating solution for the antihalation layer.

4) Preparation of Coating Solution for Protective Layer on Back Surface

While keeping a temperature of a vessel at 40° C., 40 g of gelatin, 1.5 g of liquid paraffin emulsion in terms of liquid paraffin, 35 mg of benzoisothiazolinone, 6.8 g of 1 mol/L caustic soda, 0.5 g of sodium t-octylphenoxyethoxyethane sulfonate, 0.27 g of sodium polystyrene sulfonate, 2.0 g of N,N-ethylene bis(vinyl sulfone acetamide), 5.4 ml of a 2% by mass aqueous solution of a fluorinated surfactant (F-1), 5.4 ml of a 2% by mass aqueous solution of a fluorinated surfactant (F-2), 6.0 g of an acrylic acid/ethyl acrylate copolymer (ratio weight of copolymerization: 5/95) and 2.0 g of N,N-ethylenebis(vinyl sulfonamide) were mixed and made up to be 1000 ml by being added with water, thereby obtaining a coating solution for the protective layer on the back surface.

2-2. Coating of Back Layer

On the back surface side of the above-described undercoated support, the thus-obtained coating solution for the anti-halation layer and the thus-obtained coating solution for the protective layer on the back surface were simultaneously applied in a superimposing manner such that quantities of gelatin applied of the coating solution for the anti-halation layer and the coating solution for the protective layer on the back surface became 0.44 g/m$^2$ and 1.7 g/m$^2$, respectively and dried, thereby preparing the back layer.

3. Image-forming Layer and Surface Protective Layer 3-1. Preparation of Material for Coating 1) Silver Halide Emulsion Preparation of Silver Halide Emulsion 1

To 1421 ml of distilled water were added 3.1 ml of a 1% by mass aqueous potassium bromide solution, followed by further addition of 3.5 ml of an aqueous sulfuric acid solution (5 mols/liter) and 31.7 g of phthalated gelatin. The resulting mixture was maintained at 30° C. with stirring in a stainless reactor, to which were added 95.4 ml of a solution A containing 22.22 g of silver nitrate diluted with distilled water, and 97.4 ml of a solution B containing 15.3 g of potassium bromide and 0.8 g of potassium iodide diluted with distilled water, at a fixed flow rate over a period of 45 seconds. Then, 10 ml of a 3.5% by mass aqueous hydrogen peroxide solution and then 10.8 ml of a 10% by mass aqueous benzimidazole solution were added thereto.

To the resultant mixture were further added 317.5 ml of a solution C. containing 51.86 g of silver nitrate diluted with distilled water at a fixed flow rate over a period of 20 minutes, and 400 ml of a solution D containing 44.2 g of potassium bromide and 2.2 g of potassium iodide diluted with distilled water employing a controlled double jet method while maintaining a constant pAg of 8.1. 10 minutes after the commencement of adding the solutions C and D, potassium hexachloroiridate(III) was added thereto to provide $1\times10^{-4}$ mols per mol of silver. Five seconds after the completion of adding the solution C, an aqueous potassium ferrocyanide solution was added thereto to provide $3\times10^{-4}$ mols per mol of silver. pH was controlled to be 3.8 with sulfuric acid (0.5 mols/liter). Stirring was halted, and the resultant mixture was precipitated, desalted and then washed with water. pH was controlled to be 5.9 with sodium hydroxide (1 mol/liter) to thus give a dispersion of silver halide having pAg of 8.0.

The produced dispersion of silver halide was maintained with stirring at 38° C., to which was added 5 ml of a solution of 0.34% by mass 1,2-benzoisothiazolin-3-one in methanol. 40 minutes after, a solution of spectral sensitizing dye A and spectral sensitizing dye B in a ratio of 1/1 by mol in methanol was added thereto to give a total amount of the spectral sensitizing dyes A and B of $1.2\times10^{-3}$ mols per mol of silver. 1 minute after, the temperature was raised to 47° C. 20 minutes after raising, $7.6\times10^{-5}$ mols, per mol of silver, of a solution of sodium benzenethiosulfonate in methanol was added; and 5 minutes after, $2.9\times10^{-4}$ mols, per mol of silver, of a solution of tellurium sensitizer C in methanol was added, followed by ripening for 91 minutes.

Then, 1.3 ml of a solution of 0.8% by mass N,N'-dihydroxy-N"-diethylmelamine in methanol was added thereto; and 4 minutes after, $4.8\times10^{-3}$ mols, per mol of silver, of a solution of 5-methyl-2-mercaptobenzimidazole in methanol, and $5.4\times10^{-3}$ mols, per mol of silver, of a solution of 1-phenyl-2-heptyl-5-mercapto-1,3,4-triazole in methanol were added thereto, to finally prepare a silver halide emulsion 1.

The grains in the thus-prepared silver halide emulsion were silver iodobromide grains having a mean sphere-corresponding diameter of 0.042 μm and having a sphere-corresponding diameter fluctuation coefficient of 20%. The iodide content of the grains was 3.5 mol %, and the iodide was uniformly distributed within the grains. The grain size was obtained from 1000 grains using an electronic microscope and taking an average. The {100} plane ratio of the grains was determined to be 80%, as measured according to the Kubelka-Munk method.

Preparation of Silver Halide Emulsion 2

A silver halide emulsion 2 was prepared in a similar manner to the procedures for preparing the silver halide emulsion 1, except that the liquid temperature for forming the grains was changed from 30° C. to 47° C.; the solution B was prepared by diluting 15.9 g of potassium bromide with distilled water to make a volume of 97.4 ml; the solution D was prepared by diluting 45.8 g of potassium bromide with distilled water to make a volume of 400 ml; the solution C was added over a period 30 minutes; and potassium ferrocyanide was not added. Further, similarly to the procedures for the silver halide emulsion 1, precipitating, desalting, washing with water and dispersing were conducted. In addition, similarly to the procedures for the silver halide emulsion 1, spectral sensitization and chemically sensitization were performed by adding 5-methyl-2-mercaptobenzimidazole and 1-phenyl-2-heptyl-5-mercapto-1,3,4-triazole, except that a solution of the spectral sensitizing dye A and the spectral sensitizing dye B (1/1 by mol) in methanol was added to give a total amount of the dyes A and B of $7.5\times10^{-4}$ mols per mol of silver; the amount of the tellurium sensitizer C added was $1.1\times10^{-4}$ mols per mol of silver; and the amount of 1-phenyl-2-heptyl-5-mercapto-1,3,4-triazole added was $3.3\times10^{-3}$ mols per mol of silver to thus prepare a silver halide emulsion 2. The emulsion grains in the thus-prepared silver halide emulsion 2 were cubic, pure silver bromide grains having a mean sphere-corresponding diameter of 0.080 μm and having a sphere-corresponding diameter fluctuation coefficient of 20%.

Preparation of Silver Halide Emulsion 3

A silver halide emulsion 3 was prepared in a similar manner to the procedures for preparing the silver halide emulsion 1, except that the liquid temperature for forming the grains was changed from 30° C. to 27° C. Also, similarly to the procedures for the silver halide emulsion 1, precipitating, desalting, washing with water and dispersing were conducted. In addition, similarly to the procedures for the silver halide emulsion 1, a dispersion of solids (an aqueous gelatin solution) of the spectral sensitizing dye A and the spectral sensitizing dye B (ratio: 1/1 by mol) was added to give a total amount of the spectral sensitizing dyes A and B of $6\times10^{-3}$ mols per mol of silver; and the amount of the tellurium sensitizer C. added was $5.2\times10^{-4}$ mols per mol of silver, and three minutes after addition of the tellurium sensitizer, $5\times10^{-4}$ mols of bromoauric acid per mol of silver and $2\times10^{-3}$ mols of potassium thiocyanate per mol of silver were further added.

The emulsion grains in the thus-prepared silver halide emulsion 3 were silver iodobromide grains having a mean sphere-corresponding diameter of 0.034 μm and having a sphere-corresponding diameter fluctuation coefficient of 20%.

Preparation of Mixed Emulsion a for Coating Solution

70% by mass of the silver halide emulsion 1, 15% by mass of the silver halide emulsion 2 and 15% by mass of the silver halide emulsion 3 were dissolved, followed by addition of $7\times10^{-3}$ mols, per mol of silver, of an aqueous solution of 1% by mass benzothiazolium iodide. Next, $1\times10^{-3}$ mols per mol of silver of the compound of formula (1) shown in Table 1 below was added thereto, followed by addition of water to thereby make a mixed emulsion having a silver halide content of 38.2 g in terms of silver per kg of the emulsion.

2) Preparation of Fatty Acid Silver Salt Dispersion

Preparation of Fatty Acid Silver Salt Dispersion a 87.6 kg of benenic acid (EDENOR C22-85R manufactured by Henkel), 423 liters of distilled water, 49.2 liters of an aqueous NaOH solution (5 mols/liter), and 120 liters of tert-butanol were admixed together and allowed to cause reaction, with stirring at 75° C. for 1 hour, to prepare a solution of sodium behenate. Separately, 206.2 liters of an aqueous solution (pH 4.0) of 40.4 kg of silver nitrate was prepared, and maintained at 10° C. 635 liters of distilled water and 30 liters of tert-butanol were poured into a reactor and maintained at 30° C., into which were fed, with stirring, the solution containing sodium behenate prepared as above entirely and the aqueous silver nitrate solution prepared as above entirely at a predetermined flow rate, over a period of 93 minutes and 15 seconds, and 90 minutes, respectively.

At this stage, for the duration of 11 minutes after the commencement of feeding the aqueous silver nitrate solution, only the aqueous silver nitrate solution could was added, then the sodium behenate solution was started to be fed, and for the duration of 14 minutes and 15 seconds after completion of feeding the aqueous silver nitrate, only the sodium benenate solution was added to the reactor. At this stage, the temperature inside the reactor was set at 30° C., and the temperature outside it was so controlled to keep the liquid temperature inside constant.

The pipes through which the sodium behenate solution flew was kept warm by steam tracing, and the steam opening was controlled to keep the liquid temperature at the outlet of the nozzle tip at 75° C. The pipes through which the aqueous silver nitrate solution flew was kept warm by circulating cold water outside the double-walled pipe. The positions at which the sodium behenate solution and the aqueous silver nitrate solution, respectively, were added were disposed symmetrically to each other relative to the shaft of the stirrer, with the heights adjusted in order not to contact with the reaction solution.

After addition of the sodium behenate solution was completed, the reaction system was kept standing with stirring and the temperature was maintained for 20 minutes, then raised to 35° C. over 30 minutes, followed by ripening for 210 minutes. Subsequently, centrifugal filtration was conducted to separate solids, which were then washed with water until the conductivity of the filtrate water reached 30 μS/cm, to thus give a silver salt of the fatty acid as solids. The solids were stored as a wet cake without drying.

The silver behenate grains obtained as above were analyzed for the shape by electronmicroscopic photography, revealing that the obtained grains were flaky crystals having the dimensions of a=0.14 μm, b=0.4 μm and c=0.6 μm, all on average (a, b and c are determined as defined above). The mean aspect ratio was 5.2, the mean sphere-corresponding diameter was 0.52 μm and the mean sphere-corresponding fluctuation coefficient was 15%.

To the wet cake, corresponding to a weight of 260 kg in dry weight, were added 19.3 kg of polyvinyl alcohol (product name: PVA-217) and water to make a total weight of 1000 kg, followed by pre-dispersing in a homo-mixer (MODEL PM-10 manufactured by Mizuho Industry, Inc.).

Next, the pre-dispersed stock solution was processed three times in a dispersion mixer (MICROFLUIDIZER M-610 manufactured by Microfluidex International Corporation, equipped with a Z type interaction chamber) at a controlled pressure of 1,260 kg/cm$^2$ to give a dispersion of silver behenate. Cooling was carried out by bellows-type heat exchangers disposed before and after an interaction chamber, with controlling the temperature of the refrigerant to achieve a dispersion temperature of 18° C.

Preparation of Fatty Acid Silver Dispersion B

Preparation of Recrystallized Behenic Acid 100 kg of behenic acid (trade name: EDENOR C22-85R; available from Henkel Corporation) was added with 1200 kg of isopropyl alcohol and dissolved at 50° C. and, after the resultant solution was filtered by a filter of 10 μm, the resultant filtrate was cooled to be at 30° C. to allow recrystallization to proceed. A cooling rate was controlled to be 3° C./hr. Crystals obtained by the above procedures were subjected to centrifugal filtration, washed with 100 kg of isopropyl alcohol in a sprinkling manner and dried. High purity behenic acid, in which a content of behenic acid was 96% by mass, that of lignoceric acid was 2% by mass and that of arachidic acid was 2% by mass, was obtained. Analysis of the above composition was performed by esterifying such recrystallized material and then measuring the thus-esterified recrystallized material by a GC-FID method.

Preparation of Fatty Acid Silver Dispersion B 88 kg of recrystallized behenic acid, 422 L of distilled water, 49.2 L of an aqueous NaOH solution at a 5 mol/L concentration and 120 L of t-butyl alcohol were mixed and, then, the resultant mixture was stirred at 75° C. for one hour to allow the mixture to react, thereby obtaining a sodium behenate solution. Separately, 206.2 L (pH 4.0) of an aqueous solution containing 40.4 kg of silver nitrate was prepared and kept at 10° C. A reaction vessel containing 635 L of distilled water and 30 L of t-butyl alcohol was kept at 30° C. and, then, was added with an entire volume of the thus-obtained sodium behenate solution and an entire volume of the aqueous silver nitrate solution each at a constant flow rate consuming 93 minutes and 15 seconds, and 90 minutes, respectively, while being thoroughly mixed.

At this point, only the aqueous silver nitrate solution was added in a first 11-minute period after the start of addition thereof and, then, the sodium behenate solution was started to be added and only the sodium behenate solution was added in a last 14-minute-and-15 second period after the end of addition of the aqueous silver nitrate solution. At this time, a temperature in the reaction vessel was kept at 30° C. and was controlled externally so as to keep the liquid temperature constant.

Pipes in a feeding system of the sodium behenate solution were arranged such that a temperature of the piping was kept by circulating hot water in an outer portion of a double pipe and an outlet liquid temperature at the end of the feed nozzle was adjusted to be 75° C. Further, the pipes in the feeding system of the sodium behenate solution were regulated such that the pipes were kept warm by circulating hot water in the outer portion of the double pipe and the outlet liquid temperature at the end of the feed nozzle was allowed to be 75° C. Further, a temperature of pipes in a feeding system of a silver nitrate solution was kept by circulating cold water in an outer portion of a double pipe. A point of addition of the sodium behenate solution and a point of addition of the aqueous silver nitrate solution were symmetrically arranged around a stirring axis as a center and these points were adjusted high enough to prevent them from contacting the reaction solution.

After completion of such an addition of the sodium behenate solution, the resultant mixture was allowed to stand for 20 minutes under stirring with a temperature thereof unchanged and, then, elevated to 35° C. consuming 30 minutes and, thereafter, ripened for 210 minutes. Immediately after completion of such ripening, a solid content was separated by centrifugal filtration and, then, rinsed with water until electric conductivity of a filtrate became 30 μS/cm. Thus, a fatty acid silver salt was obtained. The thus-obtained solid content was stored in wet cake form without being dried.

When a shape of the obtained grains was assessed by a microscopic photographing, the produced silver behenate grains were crystals each having average values of a=0.21 μm, b=0.4 μm and c=0.4 μm, an average aspect ratio of 2.1, an average sphere-equivalent diameter of 0.51 μm and a coefficient of variation of the sphere-equivalent of 11%.

To the wet cake equivalent to dry solid content of 260 kg, 19.3 kg of polyvinyl alcohol (trade name; PVA-217) was added and water was further added to make a total amount up to be 1000 kg and, then, the resultant mixture was changed into a slurry state using a dissolver blade and, thereafter, preliminarily dispersed employing a pipeline mixer "PM-10".

Next, such a preliminarily dispersed stock solution was dispersed three times using the MICRO FLUIDIZER-M-610 (equipped with a Z type interaction chamber) under a pressure of 1150 kg/cm$^2$, thereby obtaining a silver behenate dispersion B. During the dispersion, cooling operation was performed such that coiled heat exchangers were attached each to an inlet and an outlet of the interaction chamber and a temperature of coolant was controlled to keep the dispersion temperature at 18° C.

3) Preparation of Reducing Agent Dispersion

Preparation of Reducing Agent Complex-1 Dispersion 10 kg of a reducing agent complex-1, 0.12 kg of triphenylphosphine oxide and 16 kg of a 10% by mass aqueous solution of a modified polyvinyl alcohol (trade name: POVAL MP203; available from Kuraray Co., Ltd.) were added with 10 kg of water and, then, mixed thoroughly to prepare a slurry. The thus-prepared slurry was fed using a diaphragm pump to a lateral sand mill (trade name: UVM-2; available from Aimex, Ltd.) filled with zirconia beads having an average diameter of 0.5 mm, dispersed for 4 hours and 30 minutes, followed by addition of 0.2 g of a benzoisothiazolinone sodium salt and water such that a concentration of the reducing agent complex reached 22% by mass, thereby obtaining a reducing agent complex-1 dispersion.

As to reducing agent complex grains contained in the thus-obtained reducing agent complex dispersion, a dispersion time period was adjusted such that an average grain size thereof became 0.45 μm in terms of a median diameter. A maximum grain diameter of these grains of the dispersion was 1.4 μm or less. The obtained dispersion was filtered through a polypropylene-made filter having a pore diameter of 3.0 μm to remove foreign matters such as dust and the like and, then, stored.

Preparation of Reducing Agent-2 Dispersion 10 kg of a reducing agent-2, 16 kg of a 10% by mass aqueous solution of a modified polyvinyl alcohol "MP203" and 10 kg of water were added and, then, mixed thoroughly to prepare a slurry. The thus-prepared slurry was fed using a diaphragm pump to a lateral sand mill "UVM-2" filled with zirconia beads having an average diameter of 0.5 mm, dispersed for 3 hours and 30 minutes, followed by addition of 0.2 g of a benzoisothiazolinone sodium salt and water such that a concentration of the reducing agent reached 25% by mass. The resultant dispersion was heated at 60° C. for 5 hours to obtain a reducing agent-2 dispersion.

As to reducing agent grains contained in the thus-obtained reducing agent dispersion, a dispersion time period was adjusted such that an average grain size thereof became 0.40 μm in terms of a median diameter. A maximum grain diameter of these grains of the dispersion was 1.5 μm or less. The obtained dispersion was filtered through a polypropylene-made filter having a pore diameter of 3.0 μm to remove foreign matters such as dust and the like and, then, stored.

4) Preparation of Hydrogen Bond-Forming Compound-1 Dispersion 10 kg of a hydrogen bond-forming compound-1 and 16 kg of a 10% by mass aqueous solution of a modified polyvinyl alcohol "MP203" were added with 10 kg of water and, then, mixed thoroughly to prepare a slurry. The thus-prepared slurry was fed using a diaphragm pump to a lateral sand mill "UVM-2" filled with zirconia beads having an average diameter of 0.5 mm, dispersed for 3 hours and 30 minutes, followed by addition of 0.2 g of a benzoisothiazolinone sodium salt and water such that a concentration of the hydrogen bond-forming compound reached 25% by mass. The resultant dispersion was heated at 80° C. for one hour to obtain a hydrogen bond-forming compound-1 dispersion.

Hydrogen bond-forming compound grains contained in the thus-obtained dispersion were found to have an average grain size of 0.35 μm in terms of a median diameter and a maximum grain diameter of 1.5 μm or less. The obtained dispersion was filtered through a polypropylene-made filter having a pore diameter of 3.0 μm to remove foreign matters such as dust and the like and, then, stored.

5) Preparation of Developing Accelerator-1 Dispersion 10 kg of a developing accelerator-1 and 20 kg of a 10% by mass aqueous solution of a modified polyvinyl alcohol "MP203" were added with 10 kg of water and, then, mixed thoroughly to prepare a slurry. The thus-prepared slurry was fed by using a diaphragm pump to a lateral sand mill "UVM-2" filled with zirconia beads having an average diameter of 0.5 mm, dispersed for 3 hours and 30 minutes, added with 0.2 g of a benzoisothiazolinone sodium salt and water such that a concentration of the developing accelerator was arranged to be 20% by mass, thereby obtaining a developing accelerator-1 dispersion.

Developing accelerator grains contained in the thus-obtained development accelerator-1 dispersion were found to have a median diameter of 0.48 μm and a maximum grain diameter of 1.4 μm or less. The obtained developing accelerator-1 dispersion was filtered through a polypropylene-made filter having a pore diameter of 3.0 μm to remove foreign matters such as dust and the like and, then, stored.

6) Solid Dispersions of Developing Accelerator-2 and Color Tone Adjusting Agent-1

As to respective solid dispersions of a developing accelerator-2 and a color tone adjusting agent-1, dispersion operations were performed in a same manner as in the developing accelerator-1 to obtain respective 20% by mass dispersion liquids.

7) Preparation of Polyhalogen Compound Dispersion

Organic Polyhalogen Compound-1 Dispersion 10 kg of an organic polyhalogen compound-1, 10 kg of a 20% by mass aqueous solution of a modified polyvinyl alcohol "MP203" and 0.4 kg of a 20% by mass aqueous solution of sodium triisopropylnaphthalene sulfonate were added with 14 kg of water and, then, mixed thoroughly to prepare a slurry. The thus-prepared slurry was fed using a diaphragm pump to a lateral sand mill "UVM-2" filled with zirconia beads having an average diameter of 0.5 mm, dispersed for 5 hours as a reference time period, added with 0.2 g of a benzoisothiazolinone sodium salt and water such that a concentration of an organic polyhalogen compound reached 26% by mass, thereby obtaining an organic polyhalogen compound-1 dispersion.

Organic polyhalogen compound grains contained in the thus-obtained dispersion were found to have a median diameter of 0.41 μm and a maximum grain diameter of 2.0 μm or less. The obtained organic polyhalogen compound dispersion was filtered through a polypropylene-made filter having a pore size of 10.0 μm to remove foreign matters such as dust and the like and, then, stored.

Organic Polyhalogen Compound-2 Dispersion 10 kg of an organic polyhalogen compound-2, 20 kg of a 10% by mass aqueous solution of a modified polyvinyl alcohol "MP203" and 0.4 kg of a 20% by mass aqueous solution of sodium triisopropylnaphthalene sulfonate were added to one another and, then, mixed thoroughly so as to prepare a slurry. The thus-prepared slurry was fed using a diaphragm pump to a lateral sand mill "UVM-2" which had been filled with zirconia beads having an average diameter of 0.5 mm, dispersed for 5 hours, added with 0.2 g of a benzoisothiazolinone sodium salt and water such that a concentration of an organic polyhalogen compound reached 30% by mass. The resultant dispersion was heated at 40° C. for 5 hours to obtain an organic polyhalogen compound-2 dispersion.

Organic polyhalogen compound grains contained in the thus-obtained dispersion were found to have an average grain size of 0.40 μm in terms of a median diameter and a maximum grain diameter of 1.3 μm or less. The obtained organic polyhalogen compound dispersion was filtered through a polypropylene-made filter having a pore size of 3.0 μm to remove foreign matters such as dust and the like and, then, stored.

8) Preparation of Phthalazine Compound-1 Solution 8 kg of a modified polyvinyl alcohol "MP203" was dissolved in 174.57 kg of water and, then, added with 3.15 kg of a 20% by mass aqueous solution of sodium triisopropylnaphthalene sulfonate and 14.28 kg of a 70% by mass aqueous solution of a phthalazine compound-1, thereby preparing a 5% by mass solution of the phthalazine compound-1.

9) Preparation of Mercapto Compound Aqueous Solution

Preparation of Mercapto Compound-1 Aqueous Solution 7 g of a mercapto compound-1 was dissolved in 993 g of water to prepare a 0.7% by mass aqueous solution.

Preparation of Mercapto Compound-2 Aqueous Solution 20 g of a mercapto compound-2 was dissolved in 980 g of water to prepare a 2.0% by mass aqueous solution.

10) Preparation of Pigment-1 Dispersion 64 g of C. I. Pigment "Blue 60" and 6.4 g of "DEMOL-N" were added with 250 g of water and, then, mixed thoroughly to prepare a slurry. The thus-prepared slurry was then fed into a vessel together with 800 g of zirconia beads having an average diameter of 0.5 mm and, then, dispersed for 25 hours using a 1/4G sand grinder mill (available from Aimex, Limited.), taken out of the vessel and diluted with water to obtain a pigment-1 dispersion having a pigment concentration of 5% by mass. An average grain diameter of pigment contained in the thus-obtained dispersion was 0.21 $\mu$m.

11) Preparation of SBR Latex Liquid

SBR latex having a Tg of 22° C. was prepared in such a manner as described below. 70.0 parts by mass of styrene, 27.0 parts by mass of butadiene and 3.0 parts by mass of acrylic acid were emulsion-polymerized by using ammonium persulfate as a polymerization initiator and an anionic surfactant as an emulsifier and, then, ripened at 80° C. for 8 hours. Thereafter, the resultant polymer solution was cooled down to 40° C., adjusted so as to have a pH of 7.0 by using ammonia water, added with "SANDET-BL" (available from Sanyo Chemical Industries) so as to attain a concentration of 0.22% and, then, further added with a 5% NaOH aqueous solution so as to adjust a pH of the solution to be 8.3 and, thereafter, with ammonia water so as to adjust a pH thereof to be 8.4.

A molar ratio of $Na^+$ ion: $NH_4^+$ ion was 1:2.3. Further, 0.15 ml of a 7% aqueous solution of a bonzoisothiazolinnone sodium salt per kg of the resultant solution was added to the resultant solution, thereby preparing an SBR latex liquid.

(SBR latex: Latex of -St(70.0)-Bu(27.0)-AA(3.0))

A Tg: 22° C.; an average grain diameter: 0.1 $\mu$m; a concentration: 43% by mass; an equilibrium water content at 25° C., 60% RH: 0.6% by mass; ion conductivity: 4.2 mS/cm (measured on a latex stock liquid (43% by mass) at 25° C. using a conductometer "CM-30S" (available from Toa Denpa Kogyo K.K.); and pH: 8.4.

An SBR latex having a different Tg can be prepared in a same manner as in the above-described preparation by appropriately changing ratios of styrene and butadiene.

3-2) Preparation of Coating Solution

1) Preparation of Coating Solution-1 for Image-Forming Layer 1000 g of the above-obtained fatty acid silver dispersion A, 276 ml of water, 33 g of the pigment-1 dispersion, 21 g of the organic polyhalogen compound-1 dispersion, 58 g of the organic polyhalogen compound-2 dispersion, 173 g of the phthalazine compound-1 solution, 1082 g of the SBR latex (Tg: 22° C.) liquid, 299 g of the reducing agent complex-1 dispersion, 6 g of the development accelerator-1 dispersion, 9 ml of the mercapto compound-1 aqueous solution and 27 ml of the mercapto compound-2 aqueous solution were mixed successively and, then, 117 g of a silver halide mixed emulsion A was added to the resultant mixture just before it was applied and, thereafter, thoroughly mixed to obtain a coating solution for the emulsion layer which was then directly fed to a coating die and applied.

Viscosity of the thus-obtained coating solution for the emulsion layer was measured using a B type viscometer (available from Tokyo Keiki K.K.) at 40° C. (with No. 1 rotor at 60 rpm) and found to be 25 mPa.S.

Viscosities of the coating solution measured under shearing velocities of 0.1, 1, 10, 100 and 1,000 (1/second) at 25° C. by using "RFS Fluid Spectrometer" (available from Rheometrix Far East Inc.) were 230, 60, 46, 24 and 18 mPa.S, respectively.

Further, an amount of zirconium in the coating solution was 0.38 mg per g of silver.

2) Preparation of Coating Solution-2 for Image-Forming Layer 1000 g of the above-obtained fatty acid silver dispersion B, 276 ml of water, 35 g of the pigment-1 dispersion, 32 g of the organinc polyhalogen compound-1 dispersion, 46 g of the organinc polyhalogen compound-2 dispersion, 173 g of the phthalazine compound-1 solution, 1082 g of the SBR latex (Tg: 22° C.) liquid, 153 g of the reducing agent-2 dispersion, 55 g of the hydrogen bond-forming compound-1 dispersion, 4.8 g of the development accelerator-1 dispersion, 5.2 g of the development accelerator-2 dispersion, 2.1 g of the color tone adjusting agent-1 dispersion, 8 ml of the mercapto compound-2 aqueous solution were mixed successively and, then, 140 g of a silver halide mixed emulsion A was added to the resultant mixture just before it was applied and, thereafter, thoroughly mixed to obtain a coating solution for the emulsion layer which was then directly fed to a coating die and applied.

Viscosity of the thus-obtained coating solution for the emulsion layer was measured using a B type viscometer (available from Tokyo Keiki K.K.) at 40° C. (with No. 1 rotor at 60 rpm) and found to be 40 mPa.S.

Viscosities of the coating solution measured under shearing velocities of 0.1, 1, 10, 100 and 1,000 (1/second) at 25° C. by using "RFS Fluid Spectrometer" (available from Rheometrix Far East Inc.) were 530, 144, 96, 51 and 28 mPa.S, respectively.

Further, an amount of zirconium in the coating solution was 0.25 mg per g of silver.

3) Preparation of Coating Solution for Intermediate Layer

A coating solution for an intermediate layer was prepared by mixing 1000 g of polyvinyl alcohol "PVA-205" (available from Kuraray Co., Ltd.), 272 g of the pigment-i dispersion, 4200 ml of a 19% by mass liquid of a latex of methyl methacrylate/styrene/butyl acrylate/hydroxyethyl methacrylate/acrylic acid copolymer (weight ratio of copolymerization: 64/9/20/5/2) and 27 ml of a 5% by mass aqueous solution of "Aerosol OT" (available from American Cyanamide Corporation), 135 ml of a 20% by mass aqueous solution of diammonium phthalate and, then, the thus-prepared coating solution was added with water to make a total amount thereof up to 10000 g and, thereafter, allowed the thus-made up coating solution to be adjusted by NaOH such that it had a pH of 7.5. Then, the thus-adjusted coating solution for the intermediate layer was fed to a coating die so as to attain a coating amount of 9.1 ml/$m^2$.

Viscosity of the coating solution measured at 40° C. using a B type viscometer (with No. 1 rotor at 60 rpm) was 58 mPa.S.

4) Preparation of Coating solution for First Surface Protective Layer 64 g of inert gelatin was dissolved in water and, then, to the resultant solution added were 80 g of a 27.5% by mass solution of a latex of methyl methacrylate/styrene/butyl acrylate/hydroxyethyl methacrylate/acrylic acid copolymer (weight ratio of copolymerization: 64/9/20/5/2), 23 ml of a 10% by mass methanol solution of phthalic acid, 23 ml of a 10% by mass aqueous solution of 4-methyl phthalic acid, 28 ml of sulfuric acid at a concentration of 0.5 mol/L, 5 ml of a 5% by mass aqueous solution of "Aerosol OT", 0.5 g of phenoxy ethanol and 0.1 g of benzoisothiazolinone, and, then, a total weight of the resultant coating solution was made up to 750 g by adding water, thereby preparing a coating solution. The thus-prepared coating solution was mixed with 26 ml of a 4% by mass chrome alum solution by using a static mixer immediately before a coating operation and fed to a coating die so as to attain a coating amount of 18.6 ml/m$^2$.

Viscosity of the coating solution measured at 40° C. using a B type viscometer (with No. 1 rotor at 60 rpm) was 20 mPa.S.

5) Preparation of Coating Solution for Second Surface Protective Layer 80 g of inert gelatin was dissolved in water and, then, to the resultant solution added were 102 g of a 27.5% by mass solution of a latex of methyl methacrylate/styrene/butyl acrylate/hydroxyethyl methacrylate/acrylic acid copolymer (weight ratio of copolymerization: 64/9/20/5/2), 3.2ml of a 5% by mass solution of the fluorinated surfactant F-1, 32 ml of a 2% by mass aqueous solution of the fluorinated surfactant F-2, 23 ml of a 5% by mass solution of "Aerosol 0T", 4 g of polymethylmethacrylate microparticles (average grain diameter: 0.7 μm), 21 g of polymethylmethacrylate microparticles (average grain diameter: 4.5 μm), 1.6 g of 4-methylphthalic acid, 4.8 g of phthalic acid, 44 ml of sulfuric acid at a concentration of 0.5 mol/L and 10 mg of benzoisothiazolinone, and, then, a total weight of the resultant coating solution was made up to 650 g by adding water, thereby preparing a coating solution. The thus-prepared coating solution was mixed with 445 ml of an aqueous solution containing 4% by mass of chrome alum solution and 0.67% by mass of phthalic acid by using a static mixer immediately before a coating operation and fed to a coating die so as to attain a coating amount of 8.3 ml/m$^2$.

Viscosity of the coating solution measured at 40° C. by using a B type viscometer (with No. 1 rotor at 60 rpm) was 19 mPa.s.

3-2. Preparation of Coating Sample

1) Preparation of Thermally Developable Photosensitive Material-1

Comparative Sample

On an undercoat surface of a side opposite to a back surface, an image-forming layer, an intermediate layer, a first surface protective layer and a second surface protective layer were simultaneously applied and layered in this order using a slide bead application method and dried to prepare a thermally developable photosensitive material-1. At this time, a coating temperature of the image-forming layer and the intermediate layer was adjusted to be 31° C., while coating temperatures of such first and second layers of such protective layer were adjusted to be 36° C. and 37° C., respectively.

Coating amounts (g/m$^2$) of respective compounds in the emulsion layer are as follows:

| | |
|---|---|
| fatty acid silver dispersion A (in terms of an amount of fatty acid silver) | 5.58 |
| C.I. Pigment Blue 60 | 0.036 |
| organic polyhalogen compound-1 | 0.12 |
| organic polyhalogen compound-2 | 0.37 |
| phthalazine compound-1 | 0.19 |
| SBR latex | 9.98 |
| reducing agent complex-1 | 1.41 |
| development accelerator-1 | 0.025 |

-continued

| | |
|---|---|
| mercapto compound-1 | 0.002 |
| mercapto compound-2 | 0.012 |
| silver halide (in terms of Ag) | 0.091 |

Coating and drying conditions are as follows:

Coating was performed at a speed of 160 m/min while keeping a gap between an end of a coating die and a support to be from 0.10 mm to 0.30 mm and keeping a pressure in a reduced pressure chamber lower by from 196 Pa to 882 Pa than the atmospheric pressure. The support was blown with ion wind before coating for destaticization.

Next, the coated liquid was cooled in a chilling zone by blowing wind having a dry-bulb temperature of from 10° C. to 20° C. and, then, transferred in a non-contact type manner and, thereafter, dried by a drying wind having a dry-bulb temperature of from 23° C. to 45° C. and a wet-bulb temperature of from 15° C. to 21 ° C. in a helical non-contact type drying apparatus.

After the coating solution was dried, the thus-dried coating solution was moisture-conditioned at 25° C. such that it had a moisture of from 40% RH to 60% RH and, then, a surface of the resultant film was heated up to from 70° C. to 90° C. and, subsequently, cooled down to 25° C.

A degree of matting expressed by Beck smoothness of the thus-prepared thermally developable photosensitive material was found to be 550 seconds for the image-forming layer side and 130 seconds for the back surface. Further, a pH of the film surface on a side of a surface provided with the image-forming layer was measured and found to be 6.0.

2) Preparation of Thermally Developable Photosensitive Material-2

Comparative Sample

A thermally developable photosensitive material-2 was prepared in the same manner as in the thermally developable photosensitive material-1 except that the image-forming layer coating solution-1 was changed to an image-forming layer coating solution-2, the yellow dye compound-1 was removed from the anti-halation layer and the fluorinated surfactants F-1 to F-2 of the back surface protective layer and the surface protective layer on a side of the image-forming layer were changed to fluorinated surfactants F-3 and F-4.

Coating amounts (g/m$^2$) of respective compounds in the emulsion layer are as follows:

| | |
|---|---|
| fatty acid silver dispersion B (in terms of an amount of fatty acid silver) | 5.27 |
| C.I. Pigment Blue 60 | 0.036 |
| organic polyhalogen compound-1 | 0.17 |
| organic polyhalogen compound-2 | 0.28 |
| phthalazine compound-1 | 0.18 |
| SBR latex | 9.43 |
| reducing agent-2 | 0.77 |
| hydrogen bond-forming compound | 0.28 |
| developing accelerator-1 | 0.019 |
| developing accelerator-2 | 0.020 |
| color tone adjusting agent-1 | 0.008 |
| mercapto compound-2 | 0.003 |
| silver halide (in terms of Ag) | 0.091 |

Chemical structures of compounds used in embodiments according to the invention are shown below.

Spectral sensitizing dye A
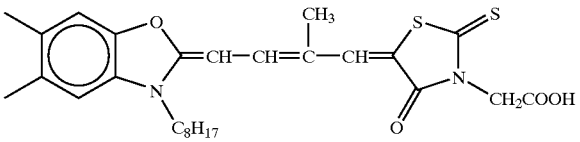
Spectral sensitizing dye B
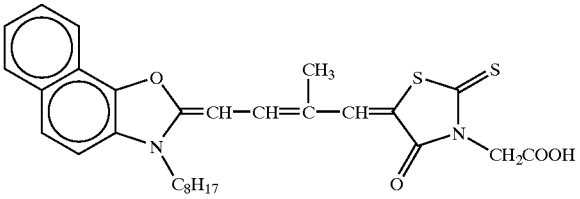
Tellurium sensitizer C
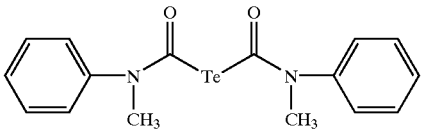
Basic precursor compound-1
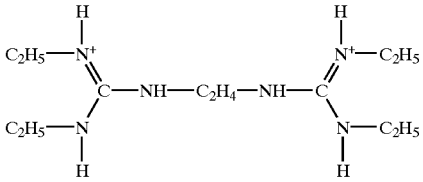
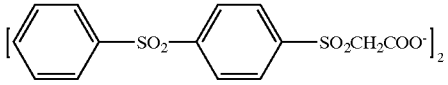
Cyanine dye compound-1
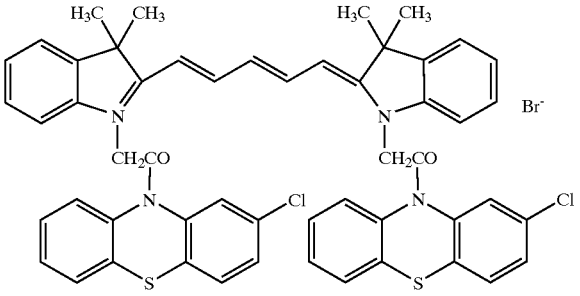
-continued
Blue dye compound-1
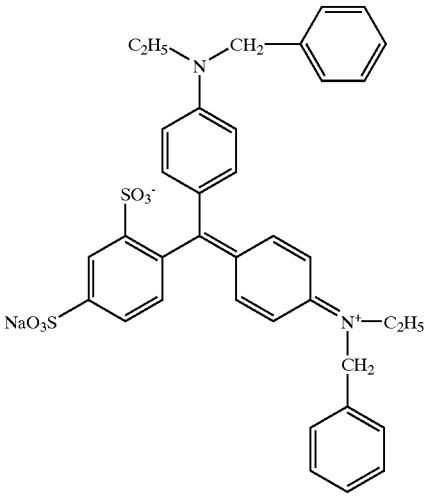
Yellow dye compound-1
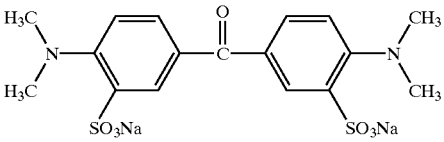
Reducing agent complex-1
1:1 complex of
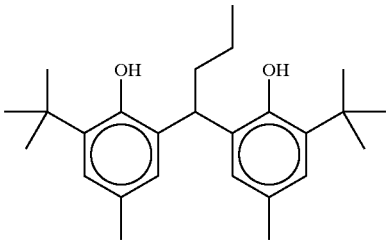
and
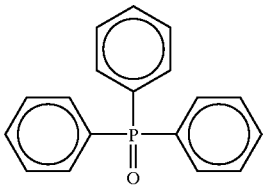
Reducing agent-2
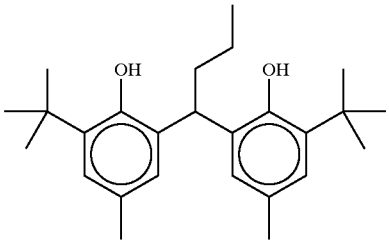

-continued

Hydrogen bond-forming compound-1

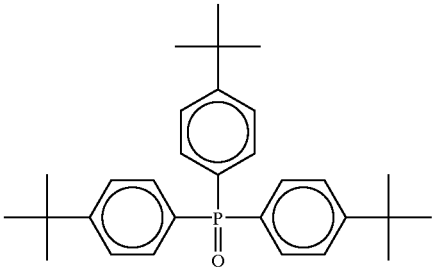

Polyhalogen compound-1

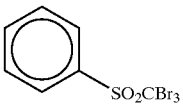

Polyhalogen compound-2

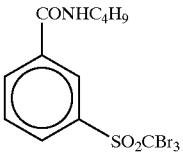

Mercapto compound-1

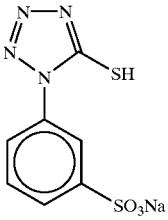

Mercapto compound-2

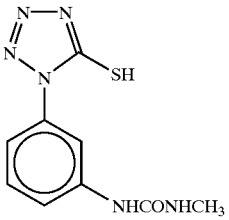

Phthalazine compound-1

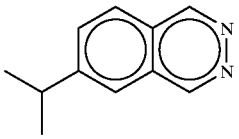

Developing accelerator-1

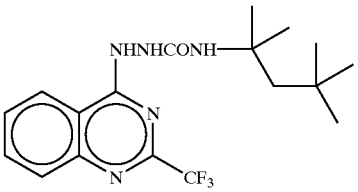

-continued

Developing accelerator-2

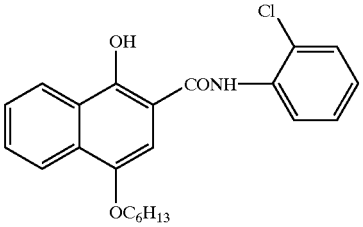

Color tone adjusting agent-1

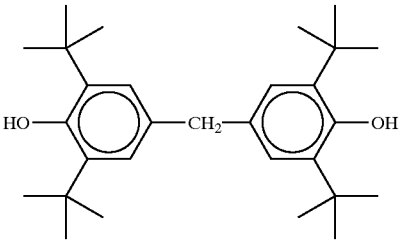

(F-1)

$CF_3(CF_2)nCH_2CH_2SCH_2CH_2COOLi$ a mixture of n=5 to 11

(F-2)

$CF_3(CF_2)nCH_2CH_2O\ (CH_2CH_2O)mH$ a mixture of n=5 to 11, and m =5 to 15

(F-3)

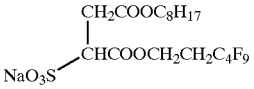

(F-4)

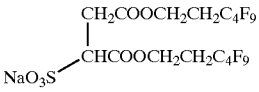

3) Preparation of Sample according to the Invention

Samples 1A, 1B, 1C, 1D and 1E were prepared by adding a 20% by mass aqueous solution of urea to the above-described thermally developable photosensitive material-1 in an amount of 30 mg/m$^2$, 60 mg/m$^2$, 100 mg/m$^2$, 150 mg/m$^2$ and 300 mg/m$^2$, respectively.

4. Evaluation of Photographic Performance

Preparation

Each of the thus-prepared samples was cut into a half size, packaged by a packaging material described below under an atmosphere of 25° C. and 50% RH and stored at normal temperature for 2 weeks.

Packaging Material

PET: 10 μm/PE: 12 μm/aluminum foil: 9 μm/Ny: 15 μm/polyethylene containing 3% of carbon: 50 μm; oxygen permeability: 0.02 ml/atm·m$^2$·25° C.·day; and water permeability: 0.10 g/atm·m$^2$·25° C.·day.

Light Exposure of Thermally Developable Photosensitive Material

Light exposure was performed on the thus-prepared samples using a laser sensitometer equipped with a 660-nm semiconductor laser device.

Thermal Development

Such samples subjected to the light exposure were thermally developed using a thermal developing apparatus equipped with a multi-step panel heater under following conditions:

a) Thermal development was performed for a total of 24 seconds, that is, 6 seconds at 110° C. and, subsequently, 18 seconds at 119° C; and b) Thermal development was performed for a total of 24 seconds, that is, 6 seconds at 114° C. and, subsequently, 18 seconds at 123° C.

Evaluation of Samples

Thus obtained samples were measured for density using a densitometer to prepare a characteristic curve of density against a logarithm of an exposure light amount. In regard to sensitivity, an optical density of an unexposed portion was defined as fog, a reciprocal number of an exposing light amount which can obtain an optical density of 1.0 was defined as a reference value and, then, a difference of sensitivities (ΔlogE1) obtained under the above-described conditions a) and b) was evaluated. The development temperature of the condition b) is higher by 4° C. than that of the condition a), and hence, the materials have a tendency to exhibit a higher sensitivity than that under the condition a) since development under the condition b) proceeds still farther. It is preferable that the thermally developable photosensitive material displays consistent desirable performances (e.g., sensitivity and color tone of image) without causing fluctuation due to variation of the thermal development temperature.

A difference of sensitivities (ΔlogE2) between development for a total of 20 seconds, that is, 5 seconds at 112° C. and 15 seconds at 121° C., and the development for a total of 28 seconds, that is, 7 seconds at 112° C. and 21 seconds at 121° C. was measured.

This difference of sensitivity reflects an extent to which the sensitivity fluctuates along with a variation of the thermal development time. It is preferable that such a fluctuation of the thermally developable photosensitive material is as small as possible.

Further, an image color tone of each of the above-described samples at a density of 1.5 was visually observed to evaluate a difference of silver color tones when the development temperature and development time period were fluctuated. The results are shown in Table 1. Symbols in Table 1 denote as follows:

X: a color tone difference is extremely large, and thus the sample is not applied for practical use.

Δ: a color tone difference is manifested, but the sample has an acceptable level for practical use.

○: a color tone difference is small, and hence the sample is good.

◎: a color tone difference is scarcely manifested, and hence the sample is good.

TABLE 1

| Sample No. | Compound (1) Addition amount | Temperature dependency ΔLogE1 | Temperature dependency Silver color tone | Time dependency ΔLogE2 | Time dependency Silver color tone | Remarks |
|---|---|---|---|---|---|---|
| 1 | None | 0.14 | X | 0.15 | Δ | Comp. Example |
| 1A | 30 mg/m$^2$ | 0.09 | Δ | 0.12 | ○ | Present Invention |
| 1B | 60 mg/m$^2$ | 0.07 | ○ | 0.10 | ◎ | Present Invention |
| 1C | 100 mg/m$^2$ | 0.05 | ◎ | 0.08 | ◎ | Present Invention |
| 1D | 150 mg/m$^2$ | 0.03 | ◎ | 0.06 | ○ | Present Invention |
| 1E | 300 mg/m$^2$ | 0.02 | ○ | 0.05 | Δ | Present Invention |

As seen from the results shown in Table 1, it is apparent that the sensitivity difference and silver color tone difference caused by a change in the development temperature and the development time period can considerably be reduced by adding the compound according to the invention.

Example 2

Samples 2A, 2B, 2C, 2D and 2E were prepared by adding a 20% aqueous solution of urea to the above-described thermally developable photosensitive material-2 in an amount of 30 mg/m$^2$, 60 mg/m$^2$, 100 mg/m$^2$, 150 mg/m$^2$ and 300 mg/m$^2$, respectively. A difference of sensitivities (ΔlogE1) between a case in which the thermally developable photosensitive material-2 was thermally developed for a total of 14 seconds, that is, a total of 3.5 seconds at 110° C. and, subsequently, 9.5 seconds at 119° C. and another case in which the thermally developable photosensitive material-2 was thermally developed for a total of 14 seconds, that is, 3.5 seconds at 114° C. and, subsequently, 9.5 seconds at 123° C. was measured.

Further, a difference of sensitivities (ΔlogE2) between a case in which a total development time period was 12 seconds and another case in which a total development time period was 16 seconds was measured, while keeping a time ratio in a temperature pattern of 112° C.-121° C. to be 1/3. Still further, a silver color tone of each of the above-described samples at a density of 1.5 was visually observed to evaluate a difference of silver color tones when the development temperature and development time period were fluctuated.

The results are shown in Table 2.

TABLE 2

| Sample No. | Compound (1) Addition amount | Temperature dependency ΔLogE1 | Temperature dependency Silver color tone | Time dependency ΔLogE2 | Time dependency Silver color tone | Remarks |
|---|---|---|---|---|---|---|
| 2 | None | 0.18 | X | 0.19 | Δ | Comp. Example |
| 2A | 30 mg/m$^2$ | 0.11 | Δ | 0.13 | ○ | Present Invention |
| 2B | 60 mg/m$^2$ | 0.08 | ○ | 0.10 | ◎ | Present Invention |
| 2C | 100 mg/m$^2$ | 0.06 | ◎ | 0.07 | ◎ | Present Invention |
| 2D | 150 mg/m$^2$ | 0.04 | ◎ | 0.05 | ○ | Present Invention |
| 2E | 300 mg/m$^2$ | 0.03 | ○ | 0.03 | Δ | Present Invention |

As seen from the results in Table 2, it is apparent that the sensitivity difference and silver color tone difference caused by a change in the development temperature and the development time period can significantly be reduced by adding the compound according to the invention.

Example 3

The thermally developable photosensitive material-3 was prepared in the same manner as for the above-described thermally developable photosensitive material-2, except that the developing accelerator-2 and the color tone adjusting agent-1 were not used.

Samples 3A, 3B, 3C, 3D and 3E were prepared by adding a 20% aqueous solution of urea to the above-described thermally developable photosensitive material-3 in an amount of 30 mg/m$^2$, 60 mg/m$^2$, 100 mg/m$^2$, 150 mg/m$^2$ and 300 mg/m$^2$, respectively, in the same manner as shown in Example 1.

TABLE 3

| Sample No. | Compound (1) Addition amount | Temperature dependency ΔLogE1 | Temperature dependency Silver color tone | Time dependency ΔLogE2 | Time dependency Silver color tone | Remarks |
|---|---|---|---|---|---|---|
| 3 | None | 0.12 | X | 0.13 | Δ | Comp. Example |
| 3A | 30 mg/m$^2$ | 0.07 | Δ | 0.10 | ○ | Present Invention |
| 3B | 60 mg/m$^2$ | 0.06 | ○ | 0.08 | ◎ | Present Invention |
| 3C | 100 mg/m$^2$ | 0.04 | ◎ | 0.06 | ◎ | Present Invention |
| 3D | 150 mg/m$^2$ | 0.03 | ◎ | 0.05 | ○ | Present Invention |
| 3E | 300 mg/m$^2$ | 0.02 | ○ | 0.04 | Δ | Present Invention |

As seen from the results in Table 3, it is apparent that the sensitivity difference and silver color tone difference caused by a change in the development temperature and the development time period can remarkably be reduced by adding the compound according to the invention.

Example 4

Samples 1 to 12 of thermally developable photosensitive materials were prepared in the same manner as above, by adding to the aforementioned thermally developable photosensitive material-3, the reducing agent and the compound represented by the general formula (1) according the invention whose kinds and addition amounts were shown in Table 4 below.

TABLE 4

| Sample No. | Reducing agent Species | Reducing agent Addition amount | Compound (1) Species | Compound (1) Addition amount | Remarks |
|---|---|---|---|---|---|
| 1 | R-6 | 100 mol % | None | — | Comp. Example |
| 2 | R-6 | 100 mol % | 1 | 75 mg/m$^2$ | Present Invention |
| 3 | R-6 | 100 mol % | 9 | 75 mg/m$^2$ | Present Invention |
| 4 | R-6 | 100 mol % | 14 | 75 mg/m$^2$ | Present Invention |
| 5 | R-6 | 100 mol % | 21 | 75 mg/m$^2$ | Present Invention |
| 6 | R-6 | 100 mol % | 12 | 10 mg/m$^2$ | Present Invention |
| 7 | R-2 | 130 mol % | None | — | Comp. Example |
| 8 | R-2 | 130 mol % | 1 | 75 mg/m$^2$ | Present Invention |
| 9 | R-2 | 130 mol % | 3 | 75 mg/m$^2$ | Present Invention |
| 10 | R-1 | 160 mol % | None | — | Comp. Example |
| 11 | R-1 | 160 mol % | 1 | 75 mg/m$^2$ | Present Invention |
| 12 | R-1 | 160 mol % | 4 | 75 mg/m$^2$ | Present Invention |

These samples were evaluated in a similar manner to Example 3. The results are shown in Table 5.

TABLE 5

| Sample No. | Temperature dependency ΔLogE1 | Temperature dependency Silver color tone | Time dependency ΔLogE2 | Time dependency Silver color tone | Remarks |
|---|---|---|---|---|---|
| 1 | 0.14 | X | 0.12 | Δ | Comp. Example |
| 2 | 0.05 | ◎ | 0.05 | ◎ | Present invention |
| 3 | 0.08 | ○ | 0.09 | ○ | Present invention |
| 4 | 0.07 | ○ | 0.07 | ○ | Present invention |
| 5 | 0.08 | ○ | 0.08 | ○ | Present invention |
| 6 | 0.06 | ○ | 0.06 | ○ | Present invention |
| 7 | 0.18 | X | 0.15 | X | Comp. Example |
| 8 | 0.08 | ○ | 0.07 | ○ | Present invention |
| 9 | 0.11 | Δ | 0.10 | Δ | Present invention |
| 10 | 0.21 | X | 0.18 | X | Comp. Example |
| 11 | 0.09 | ○ | 0.08 | ○ | Present invention |
| 12 | 0.13 | Δ | 0.12 | Δ | Present invention |

It is apparent that similar effects can be exerted also in this case.

Thus, the thermally developable photosensitive material that exhibits a consistent finished quality even when developing conditions change can be produced by adding a specific compound according to the invention. It is a new finding and an unexpected result from prior art knowledge that the compound according to the invention can exhibit such excellent properties.

As detailed above, the present invention provides the thermally developable photosensitive material that has fewer fluctuations involving sensitivity, gradation and silver color tone due to variation of developing conditions (e.g., a temperature, a humidity or an operating temperature of a thermally developing machine) and achieves a consistent finished quality.

What is claimed is:

1. A thermally developable photosensitive material comprising: a support, and including on at least one surface of said support, a photosensitive silver halide, a non-photosensitive organic silver salt, a reducing agent for thermal development, a binder and a compound represented by the following general formula (1) in an amount of 10 mg/m$^2$ to 500 mg/m$^2$ :

Formula (1)

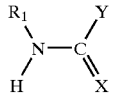

wherein $R_1$ represents a hydrogen atom, an alkyl group, a cycloalkyl group, an aryl group or a heterocyclic group; X represents a chalcogen atom; and Y represents an amino group, an N-alkylamino group, an N,N-dialkylamino group, an anilino group, a hydroxyl group, an alkoxy group, an aryloxy group, an acylamino group or a sulfonamide group, and wherein when Y represents an alkoxy group, an alkylamino group, a dialkylamino group, an acylamino group or a sulfonamide group, Y and $R_1$ may be bonded to each other to form a 5- to 7-membered ring.

2. The thermally developable photosensitive material according to claim 1, wherein in the compound represented by the general formula (1) X represents an oxygen atom or a sulfur atom; and Y represents a substituted or unsubstituted amino group, anilino group or acylamino group.

3. The thermally developable photosensitive material according to claim 1, wherein the compound represented by the general formula (1) is a urea or a thiourea.

4. The thermally developable photosensitive material according to claim 1, wherein the compound represented by the general formula (1) is used in a layer containing a photosensitive silver halide or in a layer adjacent thereto in an amount of 1 $mg/m^2$ to 1 $g/m^2$.

5. The thermally developable photosensitive material according to claim 1, wherein the non-photosensitive organic silver salt is a silver salt of a long-chain aliphatic carboxylic acid.

6. The thermally developable photosensitive material according to claim 5, wherein the silver salt of a long-chain aliphatic carboxylic acid is selected from the group consisting of silver behenate, silver arachidate, silver stearate, silver oleate, silver laurylate, silver capronate, silver myristate and silver palmitate.

7. The thermally developable photosensitive material according to claim 1, wherein the photosensitive silver halide is selected from the group consisting of silver chloride, silver chlorobromide, silver bromide, silver iodobromide, silver iodochlorobromide and silver iodide.

8. The thermally developable photosensitive material according to claim 7, wherein the photosensitive silver halide has a grain size of 0.20 $\mu$m or less.

9. The thermally developable photosensitive material according to claim 1, wherein the binder is contained in an image forming layer in an amount of 0.2 $g/m^2$ to 30 $g/m^2$.

10. The thermally developable photosensitive material according to claim 1, wherein the reducing agent is a hindered phenol type reducing agent or a bisphenol type reducing agent.

11. The thermally developable photosensitive material according to claim 9, wherein the reducing agent is contained in a surface provided with an image-forming layer in an amount of 5 mol % to 50 mol % per mol of silver.

12. The thermally developable photosensitive material according to claim 1, further comprising a developing accelerator.

13. The thermally developable photosensitive material according to claim 12, wherein the developing accelerator is used in an amount of 0.1 mol % to 20 mol % relative to the reducing agent.

14. The thermally developable photosensitive material according to claim 1, further comprising a hydrogen bond-forming compound.

15. The thermally developable photosensitive material according to claim 14, wherein the hydrogen bond-forming compound is a compound represented by the following general formula (A)

Formula (A)

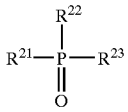

wherein $R^{21}$ to $R^{23}$ each independently represent an alkyl group, an aryl group, an alkoxy group, an aryloxy group, an amino group or a heterocyclic group.

16. The thermally developable photosensitive material according to claim 14, wherein the hydrogen bond-forming compound is used in an amount of 1 mol % to 200 mol % relative to the reducing agent.

17. The thermally developable photosensitive material according to claim 1, wherein the photosensitive silver halide is sensitized by a sensitizing dye.

18. The thermally developable photosensitive material according to claim 17, wherein the sensitizing dye is added in an amount of $10^{-6}$ mol to 1 mol per mol of silver halide in a photosensitive layer.

19. The thermally developable photosensitive material according to claim 1, wherein the silver halide in sensitized by a chemical sensitizer.

20. The thermally developable photosensitive material according to claim 19, wherein the chemical sensitizer is added in an amount of $10^{-8}$ mol to $10^{-2}$ mol per mol of silver halide.

* * * * *